US006357856B1

(12) United States Patent
Otsuki

(10) Patent No.: US 6,357,856 B1
(45) Date of Patent: Mar. 19, 2002

(54) PRINTING WITH A VERTICAL NOZZLE ARRAY HEAD

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/637,577

(22) Filed: Aug. 14, 2000

(30) Foreign Application Priority Data

Aug. 13, 1999 (JP) ..... 11-229247

(51) Int. Cl.[7] ..... B41J 2/21; B41J 2/145; B41J 2/15

(52) U.S. Cl. ..... 347/43; 347/41; 347/42

(58) Field of Search ..... 347/43, 41, 40, 347/12, 16

(56) References Cited

U.S. PATENT DOCUMENTS 4,063,254 A 12/1977 Fox et al.
4,198,642 A 4/1980 Gamblin
4,855,752 A * 8/1989 Bergstedt ..... 347/43
5,455,610 A 10/1995 Harrington

FOREIGN PATENT DOCUMENTS

JP 53-2040 1/1978
JP 3-207665 9/1991

* cited by examiner

*Primary Examiner*—Thinh Nguyen
(74) *Attorney, Agent, or Firm*—Oblon, Spivak, McClelland, Maier & Neustadt, P.C.

(57) ABSTRACT

In monochromatic printing, a recording method for middle area processing is utilized in the middle portion of the recording execution area, and bottom processing, in which the sub-scanning feed amount is smaller than in the middle area processing, is applied in the vicinity of the rear end of the recording execution area. Meanwhile, in color printing, the same recording method is applied in both the middle portion and the vicinity of the rear end of the recording execution area.

12 Claims, 25 Drawing Sheets

SCANNING PARAMETERS

NOZZLE PITCH: k = 3
NUMBER OF WORKING NOZZLES: N=4
NUMBER OF SCAN REPETITIONS: s=1
NUMBER OF EFFECTIVE NOZZLES: Neff=4

| PASS NUMBER | 1 | 2 | 3 | 4 |
|---|---|---|---|---|
| FEED AMOUNT L (DOTS) | 0 | 4 | 4 | 4 |
| ΣL | 0 | 4 | 8 | 12 |
| F=(ΣL)%k | 0 | 1 | 2 | 0 |

SCANNING PARAMETERS

NOZZLE PITCH: k = 3
NUMBER OF WORKING NOZZLES: N=4
NUMBER OF SCAN REPETITIONS: s=1
NUMBER OF EFFECTIVE NOZZLES: Neff=4

| PASS NUMBER | 1 | 2 | 3 | 4 |
|---|---|---|---|---|
| FEED AMOUNT L (DOTS) | 0 | 2 | 2 | 2 |
| ΣL | 0 | 2 | 4 | 6 |
| F=(ΣL)%k | 0 | 2 | 1 | 0 |

*Fig. 8*

SCANNING PARAMETERS DURING COLOR PRINTING

NOZZLE PITCH: k=6(DOTS)
NUMBER OF SCAN REPETITIONS: s=1
NUMBER OF WORKING NOZZLES: N=13

| PASS NUMBER | 1 | 2 | 3 | 4 | 5 | 6 | 7 |
|---|---|---|---|---|---|---|---|
| FEED AMOUNT L (DOTS) | 0 | 13 | 13 | 13 | 13 | 13 | 13 |
| $\Sigma L$ | 0 | 13 | 26 | 39 | 52 | 65 | 78 |
| $F=(\Sigma L)\%k$ | 0 | 1 | 2 | 3 | 4 | 5 | 0 |

*Fig. 10*

RECORDING METHOD DURING COLOR PRINTING

| RASTER LINES | NUMBER OF PASSES 1 | 2 | 3 | 4 | 5 | 6 | 7 | 8 | 9 | 10 | 11 | 12 | 13 | 14 | 15 | 16 | 17 | 18 | 19 | | | |
|---|---|---|---|---|---|---|---|---|---|---|---|---|---|---|---|---|---|---|---|---|---|---|
| 1 | C11 | | | | | | M14 | | | | | | M1 | | | | | | Y4 | | | |
| 2 | | C9 | | | | | | M12 | | | | | | Y15 | | | | | | Y2 | | |
| 3 | | | C7 | | | | | | M10 | | | | | | Y13 | | | | | | | |
| 4 | | | | C5 | | | | | | M8 | | | | | | Y11 | | | | | | |
| 5 | | | | | C3 | | | | | | M6 | | | | | | Y9 | | | | | |
| 6 | | | | | | C1 | | | | | | M4 | | | | | | Y7 | | | Cmis | |
| 7 | C12 | | | | | | M15 | | | | | | M2 | | | | | | Y5 | | Mmis | |
| 8 | | C10 | | | | | | M13 | | | | | | × | | | | | | Y3 | | |
| 9 | | | C8 | | | | | | M11 | | | | | | Y14 | | | | | | Y1 | Ymis |
| 10 | | | | C6 | | | | | | M9 | | | | | | Y12 | | | | | | |
| 11 | | | | | C4 | | | | | | M7 | | | | | | Y10 | | | | | |
| 12 | | | | | | C2 | | | | | | M5 | | | | | | Y8 | | | | Cmis |
| 13 | C13 | | | | | | × | | | | | | M3 | | | | | | Y6 | | | |
| 14 | | C11 | | | | | | M14 | | | | | | M1 | | | | | | Y4 | | Mmis |
| 15 | | | C9 | | | | | | M12 | | | | | | Y15 | | | | | | Y2 | Ymis |
| 16 | | | | C7 | | | | | | M10 | | | | | | Y13 | | | | | | |
| 17 | | | | | C5 | | | | | | M8 | | | | | | Y11 | | | | | |
| 18 | | | | | | C3 | | | | | | M6 | | | | | | Y9 | | | | |
| 19 | C14 | | | | | | C1 | | | | | | M4 | | | | | | Y7 | | | |
| 20 | | C12 | | | | | | M15 | | | | | | M2 | | | | | | Y5 | | |
| 21 | | | C10 | | | | | | M13 | | | | | | × | | | | | | Y3 | |
| 22 | | | | C8 | | | | | | M11 | | | | | | Y14 | | | | | | Y1 |
| 23 | | | | | C6 | | | | | | M9 | | | | | | Y12 | | | | | |
| 24 | | | | | | C4 | | | | | | M7 | | | | | | Y10 | | | | |
| 25 | C15 | | | | | | C2 | | | | | | M5 | | | | | | Y8 | | | |
| 26 | | C13 | | | | | | × | | | | | | M3 | | | | | | Y6 | | |
| 27 | | | C11 | | | | | | M14 | | | | | | M1 | | | | | | Y4 | |
| 28 | | | | C9 | | | | | | M12 | | | | | | Y15 | | | | | | Y2 |
| 29 | | | | | C7 | | | | | | M10 | | | | | | Y13 | | | | | |
| 30 | | | | | | C5 | | | | | | M8 | | | | | | Y11 | | | | |
| 31 | | | | | | | C3 | | | | | | M6 | | | | | | Y9 | | | |
| 32 | | C14 | | | | | | C1 | | | | | | M4 | | | | | | Y7 | | |
| 33 | | | C12 | | | | | | M15 | | | | | | M2 | | | | | | Y5 | |
| 34 | | | | C10 | | | | | | M13 | | | | | | × | | | | | | Y3 |
| 35 | | | | | C8 | | | | | | M11 | | | | | | Y14 | | | | | | Y1 |
| 36 | | | | | | C6 | | | | | | M9 | | | | | | Y12 | | | | |
| 37 | | | | | | | C4 | | | | | | M7 | | | | | | Y10 | | | |
| 38 | | C15 | | | | | | C2 | | | | | | M5 | | | | | | Y8 | | |
| 39 | | | C13 | | | | | | × | | | | | | M3 | | | | | | Y6 | |
| 40 | | | | C11 | | | | | | M14 | | | | | | M1 | | | | | | Y4 |

*Fig. 13*

SCANNING PARAMETERS DURING MONOCHROMATIC PRINTING

NOZZLE PITCH: k=6 (DOTS)
NUMBER OF SCAN REPETITIONS: s=1
NUMBER OF WORKING NOZZLES: N=47

| PASS NUMBER | 1 | 2 | 3 | 4 | 5 | 6 | 7 |
|---|---|---|---|---|---|---|---|
| FEED AMOUNT L (DOTS) | 0 | 47 | 47 | 47 | 47 | 47 | 47 |
| $\Sigma L$ | 0 | 47 | 94 | 141 | 188 | 235 | 282 |
| $F=(\Sigma L)\%k$ | 0 | 5 | 4 | 3 | 2 | 1 | 0 |

*Fig. 14*

RECORDING METHOD FOR MIDDLE AREA PROCESSING DURING MONOCHROMATIC PRINTING

| RASTER LINES | NUMBER OF PASSES 1 | 2 | 3 | 4 | 5 | 6 | 7 |
|---|---|---|---|---|---|---|---|
| 1 | | | | | 8 | | |
| 2 | | | | 16 | | | |
| 3 | | | 24 | | | | |
| 4 | | 32 | | | | | |
| 5 | 40 | | | | | | |
| 6 | | | | | | 1 | |
| 7 | | | | | 9 | | |
| 8 | | | | 17 | | | |
| 9 | | | 25 | | | | |
| 10 | | 33 | | | | | |
| 11 | 41 | | | | | | |
| 12 | | | | | | 2 | |
| 13 | | | | | 10 | | |
| 14 | | | | 18 | | | |
| 15 | | | 26 | | | | |
| 16 | | 34 | | | | | |
| 17 | 42 | | | | | | |
| 18 | | | | | | 3 | |
| 19 | | | | | 11 | | |
| 20 | | | | 19 | | | |
| 21 | | | 27 | | | | |
| 22 | | 35 | | | | | |
| 23 | 43 | | | | | | |
| 24 | | | | | | 4 | |
| 25 | | | | | 12 | | |
| 26 | | | | 20 | | | |
| 27 | | | 28 | | | | |
| 28 | | 36 | | | | | |
| 29 | 44 | | | | | | |
| 30 | | | | | | 5 | |
| 31 | | | | | 13 | | |
| 32 | | | | 21 | | | |
| 33 | | | 29 | | | | |
| 34 | | 37 | | | | | |
| 35 | 45 | | | | | | |
| 36 | | | | | | 6 | |
| 37 | | | | | 14 | | |
| 38 | | | | 22 | | | |
| 39 | | | 30 | | | | |
| 40 | | 38 | | | | | |
| 41 | 46 | | | | | | |
| 42 | | | | | | 7 | |
| 43 | | | | | 15 | | |
| 44 | | | | 23 | | | |
| 45 | | | 31 | | | | |
| 46 | | 39 | | | | | |
| 47 | 47 | | | | | | |
| 48 | | | | | | 8 | |
| 49 | | | | | 16 | | |
| 50 | | | | 24 | | | |
| 51 | | | 32 | | | | |
| 52 | | 40 | | | | | |
| 53 | | | | | | | 1 |

L = 47 DOTS

*Fig. 15*

SCANNING PARAMETERS DURING MONOCHROMATIC PRINTING

NOZZLE PITCH: k=6 (DOTS)
NUMBER OF SCAN REPETITIONS: s=1

| | TOP PROCESSING ← | | | | | | MIDDLE AREA PROCESSING → | | | | | |
|---|---|---|---|---|---|---|---|---|---|---|---|---|
| PASS NUMBER | 1 | 2 | 3 | 4 | 5 | 6 | 7 | 8 | 9 | 10 | 11 | 12 |
| FEED AMOUNT L (DOTS) | 0 | 5 | 5 | 5 | 5 | 5 | 47 | 47 | 47 | 47 | 47 | 47 |
| NUMBER OF WORKING NOZZLES | 8 | 16 | 24 | 32 | 40 | 47 | 12 | 19 | 26 | 33 | 40 | 47 |

Fig. 16

RECORDING METHOD FOR TOP PROCESSING DURING MONOCHROMATIC PRINTING (PART 1)

| RASTER LINES | NUMBER OF PASSES 1 | 2 | 3 | 4 | 5 | 6 | MIDDLE AREA PROCESSING → 7 |
|---|---|---|---|---|---|---|---|
| 1 | | | | | 1 | | |
| 2 | | | | 2 | | | |
| 3 | | | 3 | | | | |
| 4 | | 4 | | | | | |
| 5 | 5 | | | | | | |
| 6 | | | | | | 1 | |
| 7 | | | | | 2 | | |
| 8 | | | | 3 | | | |
| 9 | | | 4 | | | | |
| 10 | | 5 | | | | | |
| 11 | 6 | | | | | | |
| 12 | | | | | | 2 | |
| 13 | | | | | 3 | | |
| 14 | | | | 4 | | | |
| 15 | | | 5 | | | | |
| 16 | | 6 | | | | | |
| 17 | 7 | | | | | | |
| 18 | | | | | | 3 | |
| 19 | | | | | 4 | | |
| 20 | | | | 5 | | | |
| 21 | | | 6 | | | | |
| 22 | | 7 | | | | | |
| 23 | 8 | | | | | | |
| 24 | | | | | | 4 | |
| 25 | | | | | 5 | | |
| 26 | | | | 6 | | | |
| 27 | | | 7 | | | | |
| 28 | | 8 | | | | | |
| 29 | 9 | | | | | | |
| 30 | | | | | | 5 | |
| 31 | | | | | 6 | | |
| 32 | | | | 7 | | | |
| 33 | | | 8 | | | | |
| 34 | | 9 | | | | | |
| 35 | 10 | | | | | | |
| 36 | | | | | | 6 | |
| 37 | | | | | 7 | | |
| 38 | | | | 8 | | | |
| 39 | | | 9 | | | | |
| 40 | | 10 | | | | | |
| 41 | 11 | | | | | | |
| 42 | | | | | | 7 | |
| 43 | | | | | 8 | | |
| 44 | | | | 9 | | | |
| 45 | | | 10 | | | | |
| 46 | | 11 | | | | | |
| 47 | 12 | | | | | | |
| 48 | | | | | | 8 | |
| 49 | | | | | 9 | | |
| 50 | | | | 10 | | | |
| 51 | | | 11 | | | | |
| 52 | | 12 | | | | | |
| 53 | ~~13~~ | | | | | | 1 |
| 54 | | | | | | 9 | |
| 55 | | | | | 10 | | |

L=5DOTS

L=47DOTS

~~1~~ : UNUSED NOZZLE

Fig.17

RECORDING METHOD FOR TOP PROCESSING DURING MONOCHROMATIC PRINTING (PART 2)

MIDDLE AREA PROCESSING →

| RASTER LINES | NUMBER OF PASSES 1 | 2 | 3 | 4 | 5 | 6 | 7 | 8 | 9 | 10 | 11 | 12 |
|---|---|---|---|---|---|---|---|---|---|---|---|---|
| 256 | | ~~46~~ | | | | | | 27 | | | | |
| 257 | ~~47~~ | | | | | | 35 | | | | | |
| 258 | | | | | | 43 | | | | | | |
| 259 | | | | | ~~44~~ | | | | | | 4 | |
| 260 | | | | ~~45~~ | | | | | | 12 | | |
| 261 | | | ~~46~~ | | | | | | 20 | | | |
| 262 | | ~~47~~ | | | | | | 28 | | | | |
| 263 | | | | | | | 36 | | | | | |
| 264 | | | | | | 44 | | | | | | |
| 265 | | | | | ~~45~~ | | | | | | 5 | |
| 266 | | | | ~~46~~ | | | | | | 13 | | |
| 267 | | | ~~47~~ | | | | | | 21 | | | |
| 268 | | | | | | | | 29 | | | | |
| 269 | | | | | | | 37 | | | | | |
| 270 | | | | | | 45 | | | | | | |
| 271 | | | | | ~~46~~ | | | | | | 6 | |
| 272 | | | | ~~47~~ | | | | | | 14 | | |
| 273 | | | | | | | | | 22 | | | |
| 274 | | | | | | | | 30 | | | | |
| 275 | | | | | | | 38 | | | | | |
| 276 | | | | | | 46 | | | | | | |
| 277 | | | | | ~~47~~ | | | | | | 7 | |
| 278 | | | | | | | | | | 15 | | |
| 279 | | | | | | | | | 23 | | | |
| 280 | | | | | | | | 31 | | | | |
| 281 | | | | | | | 39 | | | | | |
| 282 | | | | | | 47 | | | | | | |
| 283 | | | | | | | | | | | 8 | |
| 284 | | | | | | | | | | 16 | | |
| 285 | | | | | | | | | 24 | | | |
| 286 | | | | | | | | 32 | | | | |
| 287 | | | | | | | 40 | | | | | |
| 288 | | | | | | | | | | | | 1 |
| 289 | | | | | | | | | | | 9 | |
| 290 | | | | | | | | | | 17 | | |
| 291 | | | | | | | | | 25 | | | |
| 292 | | | | | | | | 33 | | | | |
| 293 | | | | | | | 41 | | | | | |
| 294 | | | | | | | | | | | | 2 |
| 295 | | | | | | | | | | | 10 | |
| 296 | | | | | | | | | | 18 | | |
| 297 | | | | | | | | | 26 | | | |
| 298 | | | | | | | | 34 | | | | |
| 299 | | | | | | | 42 | | | | | |
| 300 | | | | | | | | | | | | 3 |
| 301 | | | | | | | | | | | 11 | |
| 302 | | | | | | | | | | 19 | | |
| 303 | | | | | | | | | 27 | | | |
| 304 | | | | | | | | 35 | | | | |
| 305 | | | | | | | 43 | | | | | |
| 306 | | | | | | | | | | | | 4 |

~~x~~ : UNUSED NOZZLE

Fig. 18

RECORDING RASTER LINES NUMBER IN TOP PROCESSING DURING MONOCHROMATIC PRINTING

TOP PROCESSING ← | MIDDLE AREA PROCESSING →

| | PASS 1 | PASS 2 | PASS 3 | PASS 4 | PASS 5 | PASS 6 | PASS 7 |
|---|---|---|---|---|---|---|---|
| | – | L=5 | L=5 | L=5 | L=5 | L=5 | L=47 |
| #1 | n/a | n/a | n/a | n/a | 1 | 6 | 53 |
| #2 | n/a | n/a | n/a | 2 | 7 | 12 | 59 |
| #3 | n/a | n/a | 3 | 8 | 13 | 18 | 65 |
| #4 | n/a | 4 | 9 | 14 | 19 | 24 | 71 |
| #5 | 5 | 10 | 15 | 20 | 25 | 30 | 77 |
| #6 | 11 | 16 | 21 | 26 | 31 | 36 | 83 |
| #7 | 17 | 22 | 27 | 32 | 37 | 42 | 89 |
| #8 | 23 | 28 | 33 | 38 | 43 | 48 | 95 |
| #9 | 29 | 34 | 39 | 44 | 49 | 54 | 101 |
| #10 | 35 | 40 | 45 | 50 | 55 | 60 | 107 |
| #11 | 41 | 46 | 51 | 56 | 61 | 66 | 113 |
| #12 | 47 | 52 | 57 | 62 | 67 | 72 | 119 |
| #13 | n/a | 58 | 63 | 68 | 73 | 78 | 125 |
| #14 | n/a | 64 | 69 | 74 | 79 | 84 | 131 |
| #15 | n/a | 70 | 75 | 80 | 85 | 90 | 137 |
| #16 | n/a | 76 | 81 | 86 | 91 | 96 | 143 |
| #17 | n/a | 82 | 87 | 92 | 97 | 102 | 149 |
| #18 | n/a | 88 | 93 | 98 | 103 | 108 | 155 |
| #19 | n/a | 94 | 99 | 104 | 109 | 114 | 161 |
| #20 | n/a | n/a | 105 | 110 | 115 | 120 | 167 |
| #21 | n/a | n/a | 111 | 116 | 121 | 126 | 173 |
| #22 | n/a | n/a | 117 | 122 | 127 | 132 | 179 |
| #23 | n/a | n/a | 123 | 128 | 133 | 138 | 185 |
| #24 | n/a | n/a | 129 | 134 | 139 | 144 | 191 |
| #25 | n/a | n/a | 135 | 140 | 145 | 150 | 197 |
| #26 | n/a | n/a | 141 | 146 | 151 | 156 | 203 |
| #27 | n/a | n/a | n/a | 152 | 157 | 162 | 209 |
| #28 | n/a | n/a | n/a | 158 | 163 | 168 | 215 |
| #29 | n/a | n/a | n/a | 164 | 169 | 174 | 221 |
| #30 | n/a | n/a | n/a | 170 | 175 | 180 | 227 |
| #31 | n/a | n/a | n/a | 176 | 181 | 186 | 233 |
| #32 | n/a | n/a | n/a | 182 | 187 | 192 | 239 |
| #33 | n/a | n/a | n/a | 188 | 193 | 198 | 245 |
| #34 | n/a | n/a | n/a | n/a | 199 | 204 | 251 |
| #35 | n/a | n/a | n/a | n/a | 205 | 210 | 257 |
| #36 | n/a | n/a | n/a | n/a | 211 | 216 | 263 |
| #37 | n/a | n/a | n/a | n/a | 217 | 222 | 269 |
| #38 | n/a | n/a | n/a | n/a | 223 | 228 | 275 |
| #39 | n/a | n/a | n/a | n/a | 229 | 234 | 281 |
| #40 | n/a | n/a | n/a | n/a | 235 | 240 | 287 |
| #41 | n/a | n/a | n/a | n/a | n/a | 246 | 293 |
| #42 | n/a | n/a | n/a | n/a | n/a | 252 | 299 |
| #43 | n/a | n/a | n/a | n/a | n/a | 258 | 305 |
| #44 | n/a | n/a | n/a | n/a | n/a | 264 | 311 |
| #45 | n/a | n/a | n/a | n/a | n/a | 270 | 317 |
| #46 | n/a | n/a | n/a | n/a | n/a | 276 | 323 |
| #47 | n/a | n/a | n/a | n/a | n/a | 282 | 329 |

*Fig. 19*

SCANNING PARAMETERS FOR BOTTOM PROCESSING
DURING MONOCHROMATIC PRINTING

NOZZLE PITCH: k=6 (DOTS)
NUMBER OF SCAN REPETITIONS: s=1

| | MIDDLE AREA PROCESSING ← | | | | | | BOTTOM PROCESSING → | | | | | |
|---|---|---|---|---|---|---|---|---|---|---|---|---|
| PASS NUMBER | -11 | -10 | -9 | -8 | -7 | -6 | -5 | -4 | -3 | -2 | -1 | 0 |
| FEED AMOUNT L (DOTS) | 47 | 47 | 47 | 47 | 47 | 47 | 15 | 5 | 5 | 5 | 5 | 5 |
| NUMBER OF WORKING NOZZLES | 47 | 47 | 47 | 47 | 47 | 47 | 26 | 19 | 11 | 3 | 42 | 34 |

RECORDING METHOD FOR BOTTOM PROCESSING DURING MONOCHROMATIC PRINTING (PART 1)

Fig.21

RECORDING METHOD FOR BOTTOM PROCESSING
DURING MONOCHROMATIC PRINTING (PART 2)

| RASTER LINES \ NUMBER OF PASSES | -6 | -5 | -4 | -3 | -2 | -1 | 0 |
|---|---|---|---|---|---|---|---|
| -46 | | | | | | | 36 |
| -45 | | | | | | 37 | |
| -44 | 43 | | | | 38 | | |
| -43 | | | | 39 | | | |
| -42 | | | 40 | | | | |
| -41 | | 41 | | | | | |
| -40 | | | | | | | 37 |
| -39 | | | | | | 38 | |
| -38 | 44 | | | | 39 | | |
| -37 | | | | 40 | | | |
| -36 | | | 41 | | | | |
| -35 | | 42 | | | | | |
| -34 | | | | | | | 38 |
| -33 | | | | | | 39 | |
| -32 | 45 | | | | 40 | | |
| -31 | | | | 41 | | | |
| -30 | | | 42 | | | | |
| -29 | | 43 | | | | | |
| -28 | | | | | | | 39 |
| -27 | | | | | | 40 | |
| -26 | 46 | | | | 41 | | |
| -25 | | | | 42 | | | |
| -24 | | | 43 | | | | |
| -23 | | 44 | | | | | |
| -22 | | | | | | | 40 |
| -21 | | | | | | 41 | |
| -20 | 47 | | | | 42 | | |
| -19 | | | | 43 | | | |
| -18 | | | 44 | | | | |
| -17 | | 45 | | | | | |
| -16 | | | | | | | 41 |
| -15 | | | | | | 42 | |
| -14 | | | | | 43 | | |
| -13 | | | | 44 | | | |
| -12 | | | 45 | | | | |
| -11 | | 46 | | | | | |
| -10 | | | | | | | 42 |
| -9 | | | | | | 43 | |
| -8 | | | | | 44 | | |
| -7 | | | | 45 | | | |
| -6 | | | 46 | | | | |
| -5 | | 47 | | | | | |
| -4 | | | | | | | 43 |
| -3 | | | | | | 44 | |
| -2 | | | | | 45 | | |
| -1 | | | | 46 | | | |
| 0 | | | 47 | | | | |
| 1 | | | | | | | |
| 2 | | | | | | | ~~44~~ |
| 3 | | | | | | ~~45~~ | |

BOTTOM PROCESSING →

PRINTING EXECUTION AREA BOTTOM

~~1~~ : UNUSED NOZZLE

Fig.22

RECORDING RASTER LINES NUMBER IN UPPER END PROCESSING DURING MONOCHROMATIC PRINTING

MIDDLE AREA PROCESSING ← | BOTTOM PROCESSING →

| | PASS-6 | PASS-5 | PASS-4 | PASS-3 | PASS-2 | PASS-1 | PASS0 |
|---|---|---|---|---|---|---|---|
| | L=47 | L=15 | L=5 | L=5 | L=5 | L=5 | L=5 |
| #1 | -296 | n/a | n/a | n/a | n/a | n/a | n/a |
| #2 | -290 | n/a | n/a | n/a | n/a | n/a | n/a |
| #3 | -284 | n/a | n/a | n/a | n/a | -249 | n/a |
| #4 | -278 | n/a | n/a | n/a | n/a | -243 | n/a |
| #5 | -272 | n/a | n/a | n/a | n/a | -237 | n/a |
| #6 | -266 | n/a | n/a | n/a | n/a | -231 | n/a |
| #7 | -260 | n/a | n/a | n/a | n/a | -225 | n/a |
| #8 | -254 | n/a | n/a | n/a | n/a | -219 | n/a |
| #9 | -248 | n/a | n/a | n/a | n/a | -213 | n/a |
| #10 | -242 | n/a | n/a | n/a | n/a | -207 | -202 |
| #11 | -236 | n/a | n/a | n/a | n/a | -201 | -196 |
| #12 | -230 | n/a | n/a | n/a | n/a | -195 | -190 |
| #13 | -224 | n/a | n/a | n/a | n/a | -189 | -184 |
| #14 | -218 | n/a | n/a | n/a | n/a | -183 | -178 |
| #15 | -212 | n/a | n/a | n/a | n/a | -177 | -172 |
| #16 | -206 | n/a | n/a | n/a | n/a | -171 | -166 |
| #17 | -200 | n/a | n/a | n/a | n/a | -165 | -160 |
| #18 | -194 | n/a | n/a | n/a | n/a | -159 | -154 |
| #19 | -188 | n/a | n/a | n/a | n/a | -153 | -148 |
| #20 | -182 | n/a | n/a | n/a | n/a | -147 | -142 |
| #21 | -176 | n/a | n/a | n/a | n/a | -141 | -136 |
| #22 | -170 | -155 | n/a | n/a | n/a | -135 | -130 |
| #23 | -164 | -149 | n/a | n/a | n/a | -129 | -124 |
| #24 | -158 | -143 | n/a | n/a | n/a | -123 | -118 |
| #25 | -152 | -137 | n/a | n/a | n/a | -117 | -112 |
| #26 | -146 | -131 | n/a | n/a | n/a | -111 | -106 |
| #27 | -140 | -125 | n/a | n/a | n/a | -105 | -100 |
| #28 | -134 | -119 | n/a | n/a | n/a | -99 | -94 |
| #29 | -128 | -113 | -108 | n/a | n/a | -93 | -88 |
| #30 | -122 | -107 | -102 | n/a | n/a | -87 | -82 |
| #31 | -116 | -101 | -96 | n/a | n/a | -81 | -76 |
| #32 | -110 | -95 | -90 | n/a | n/a | -75 | -70 |
| #33 | -104 | -89 | -84 | n/a | n/a | -69 | -64 |
| #34 | -98 | -83 | -78 | n/a | n/a | -63 | -58 |
| #35 | -92 | -77 | -72 | n/a | n/a | -57 | -52 |
| #36 | -86 | -71 | -66 | -61 | n/a | -51 | -46 |
| #37 | -80 | -65 | -60 | -55 | n/a | -45 | -40 |
| #38 | -74 | -59 | -54 | -49 | n/a | -39 | -34 |
| #39 | -68 | -53 | -48 | -43 | n/a | -33 | -28 |
| #40 | -62 | -47 | -42 | -37 | n/a | -27 | -22 |
| #41 | -56 | -41 | -36 | -31 | n/a | -21 | -16 |
| #42 | -50 | -35 | -30 | -25 | n/a | -15 | -10 |
| #43 | -44 | -29 | -24 | -19 | -14 | -9 | -4 |
| #44 | -38 | -23 | -18 | -13 | -8 | -3 | n/a |
| #45 | -32 | -17 | -12 | -7 | -2 | n/a | n/a |
| #46 | -26 | -11 | -6 | -1 | n/a | n/a | n/a |
| #47 | -20 | -5 | 0 | n/a | n/a | n/a | n/a |

FIRST VARIATION OF ACTUATOR

SECOND VARIATION OF ACTUATOR

THIRD VARIATION OF ACTUATOR

PRINTING WITH A VERTICAL NOZZLE ARRAY HEAD

BACKGROUND OF THE INVENTION

1. Field of the Invention

This invention relates to a technique for performing color printing using a printing head for forming dots of a plurality of colors.

2. Description of the Related Art

Serial scan printers and drum scan printers are examples of printers that record dots while a printing head scans in the main scanning direction and the sub-scanning direction. Some of the techniques for enhancing image quality with this type of printer, and particularly an ink jet printer, include one called "interlacing," which is disclosed in U.S. Pat No. 4,198,642 and Japanese Laid-Open Patent Application S53-2040, and one called "overlapping" or "multi-scanning," which is disclosed in Japanese Laid-Open Patent Application H3-207665.

However, a desirable dot recording method in terms of enhancing image quality depends on the orientation of the nozzle array in the printing head. Therefore, it is preferable to apply a dot recording method that is different from conventional methods to a printer having a printing head that is different from conventional heads.

SUMMARY OF THE INVENTION

It is an object of the present invention to provide a technique for performing printing using a dot recording method that is suited to a specific printing head.

In order to solve at least some of the above problems, the present invention makes use of a printing head in which first and second dot forming element arrays are arranged in parallel in the sub-scanning direction. The first dot forming element array is constructed such that a plurality of chromatic color dot forming element groups are arrayed in a specific order in the sub-scanning direction. The second dot forming element array is constructed such that a black dot forming element group for forming black dots is formed parallel to the first dot forming element array. The black dot forming element group includes a greater number of dot forming elements than each of the chromatic color dot forming element groups does. During monochromatic printing, the recording of dots in the middle portion of a recording execution area on the printing medium is executed according to a first recording method using only the second dot forming element array, and the recording of dots in the vicinity of the rear end of the recording execution area is executed according to a second recording method in which the sub-scanning feed amount is smaller than in the first recording method. Meanwhile, during color printing, the recording of dots is executed according to a third recording method using the first and second dot forming element arrays in both the middle portion and the vicinity of the rear end of the recording execution area.

The reason for applying a recording method in which the sub-scanning feed amount is smaller in the vicinity of the rear end of the printing medium than in the middle portion of the printing medium is as follows. In general, if the number of nozzles per color actually used in printing (called the "number of working nozzles") is large, then there will be a tendency for the range in which effective recording cannot be executed in the vicinity of the bottom of the printing medium (the unrecordable range) to be large, and for the range in which effective recording can be executed (the effective recording range) to be small. Since the black dot forming element group includes more dot forming elements than each of the chromatic color dot forming element groups, the unrecordable area in the vicinity of the bottom of the printing medium is larger during monochromatic printing than during color printing. In view of this, during monochromatic printing a recording method is employed in which the amount of sub-scanning feed is smaller in the vicinity of the bottom of the printing medium than in the middle area, which allows the effective recording range to be expanded. On the other hand, during color printing the number of working nozzles per color is smaller than during monochromatic printing, so a satisfactory effective recording range can be maintained even if the same recording method as in the middle area is employed, and therefore the recording of dots is executed using the same recording method in both the vicinity of the rear end and the middle area of the printing medium. Thus, with the present invention, printing that is suited to color printing and monochromatic printing can be executed using a specific printing head.

When the first dot forming element array includes a yellow dot forming element group for forming yellow dots, it is preferable if the arrangement order of the plurality of chromatic color dot forming element groups in the first dot forming element array is determined such that yellow dots will be formed after other colored dots at an arbitrary position on the printing medium. It is also preferable if the plurality of chromatic color dot forming element groups include mutually equivalent numbers of dot forming elements. The above-mentioned printer may include a first sub-scanning drive mechanism that performs sub-scanning at a relatively high precision, and a second sub-scanning drive mechanism that performs sub-scanning at a relatively low precision, at least after sub-scanning feed by the first sub-scanning drive mechanism is terminated. Here, during color printing, the operation of the dot forming element arrays is controlled so that at least half of the dots formed during main scanning are accounted for by yellow dots when sub-scanning feed is executed by the second sub-scanning drive mechanism without sub-scanning feed being executed by the first sub-scanning drive mechanism in the vicinity of the rear end of the printing medium.

In the vicinity of the rear end of the printing medium, sub-scanning feed by the first sub-scanning drive mechanism is not performed, but sub-scanning feed by the second sub-scanning drive mechanism is performed, so feed precision is relatively low. However, since yellow dots stand out less than dots of other colors, if at least half of the dots are yellow, then there will be minimal loss of image quality even if the sub-scanning feed precision is low.

It is also preferable if, during color printing, black dots are formed using just the dot forming elements present at the same sub-scanning position as the dot forming elements used in a specific chromatic color dot forming element group. The specific chromatic color dot forming element group is a group with which dots can be formed on the printing medium the earliest out of the plurality of chromatic color dot forming element groups in the first dot forming element array.

In this arrangement, black dots will be formed sooner than dots of other colors at the various positions on the printing medium, which prevents the bleeding of the black dots and allows a color image of higher saturation to be obtained.

During monochromatic printing in the vicinity of the front end of the recording execution area, the recording of dots may be executed according to a fourth recording method in which the sub-scanning feed amount is smaller than in the first recording method. Also, during color printing, the recording of dots in the vicinity of the front end of the recording execution area may be executed according to the third recording method which is also used in both the middle portion and the vicinity of the rear end of the recording execution area.

In this arrangement, the effective recording range can be expanded in the vicinity of the front end of the recording execution area in monochromatic printing, while the recording of dots will be simplified in color printing.

The present invention can assume a variety of specific embodiments, such as a printer and a printing method, a computer program for realizing the function of the printer or method, a computer readable medium on which this computer program is recorded, and a data signal embodied in a carrier wave including the computer program.

The above and other objects, characteristics, examples, and advantages of the present invention should be clear from the following description of the preferred embodiments given along with the figures.

BRIEF DESCRIPTION OF THE DRAWINGS

FIG. 8 shows the scanning parameters in an embodiment of color printing;

FIG. 10 shows which nozzles record the raster lines within the effective recording range in the various passes in an embodiment of color printing;

FIG. 13 shows the scanning parameters in middle area processing for monochromatic printing in this embodiment;

FIG. 14 shows which nozzles record the raster lines within the effective recording range in the various passes in middle area processing during monochromatic printing;

FIG. 15 shows the scanning parameters in top processing during monochromatic printing in this embodiment;

FIG. 16 shows which nozzles record the raster lines within the effective recording range in the various passes in top processing during monochromatic printing;

FIG. 17 shows which nozzles record the raster lines within the effective recording range in the various passes in top processing during monochromatic printing;

FIG. 18 shows the raster numbers in which the various nozzles are assigned to recording in the various passes in top processing during monochromatic printing;

FIG. 19 shows the scanning parameters in bottom processing during monochromatic printing in this embodiment;

FIG. 21 shows which nozzles record the raster lines within the effective recording range in the various passes in bottom processing during monochromatic printing;

FIG. 22 shows the raster line numbers in which the various nozzles are assigned to recording in the various passes in bottom processing during monochromatic printing;

DESCRIPTION OF THE PREFERRED EMBODIMENTS

A. Overall Structure of the Printer

Figure 1:
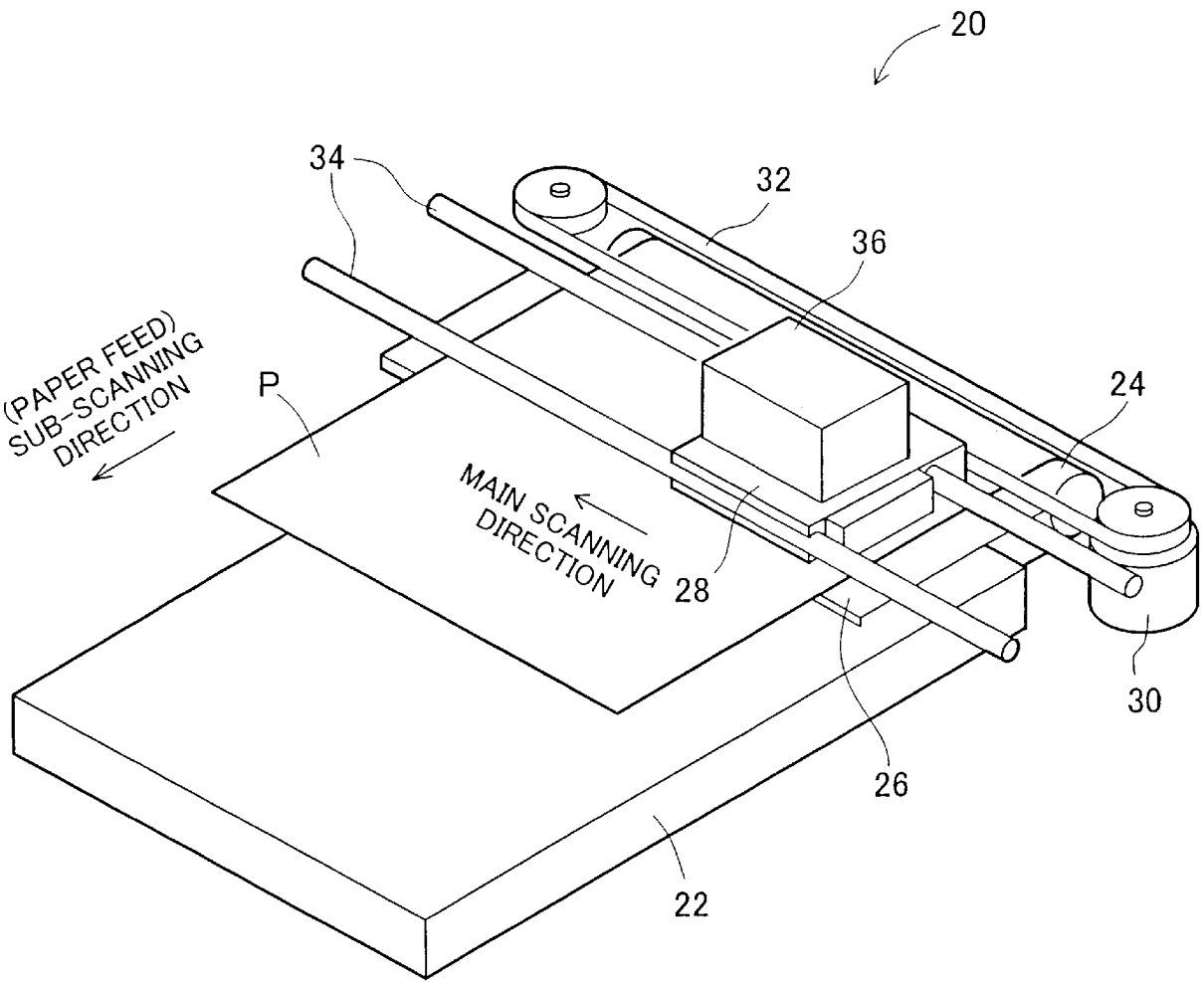
FIG. 1 is a simplified perspective view showing the main structure of a color ink jet printer 20 serving as an embodiment of the present invention.

Embodiments of the present invention will now be described through examples. FIG. 1 is a simplified perspective view showing the main structure of a color ink jet printer 20 serving as an embodiment of the present invention. This printer 20 comprises a paper stacker 22, a paper feed roller 24 driven by a step motor (not shown), a platen 26, a carriage 28, a step motor 30, a tow belt 32 driven by the step motor 30, and guide rails 34 for the carriage 28. The carriage 28 carries a printing head 36 equipped with numerous nozzles.

Printing paper P is brought from the paper stacker 22 by the paper feed roller 24, and is fed over the surface of the platen 26 in the sub-scanning direction. The carriage 28 is towed by the tow belt 32, which is driven by the step motor 30, and moves along the guide rails 34 in the main scanning direction. The main scanning direction is perpendicular to the sub-scanning direction.

Figure 2:
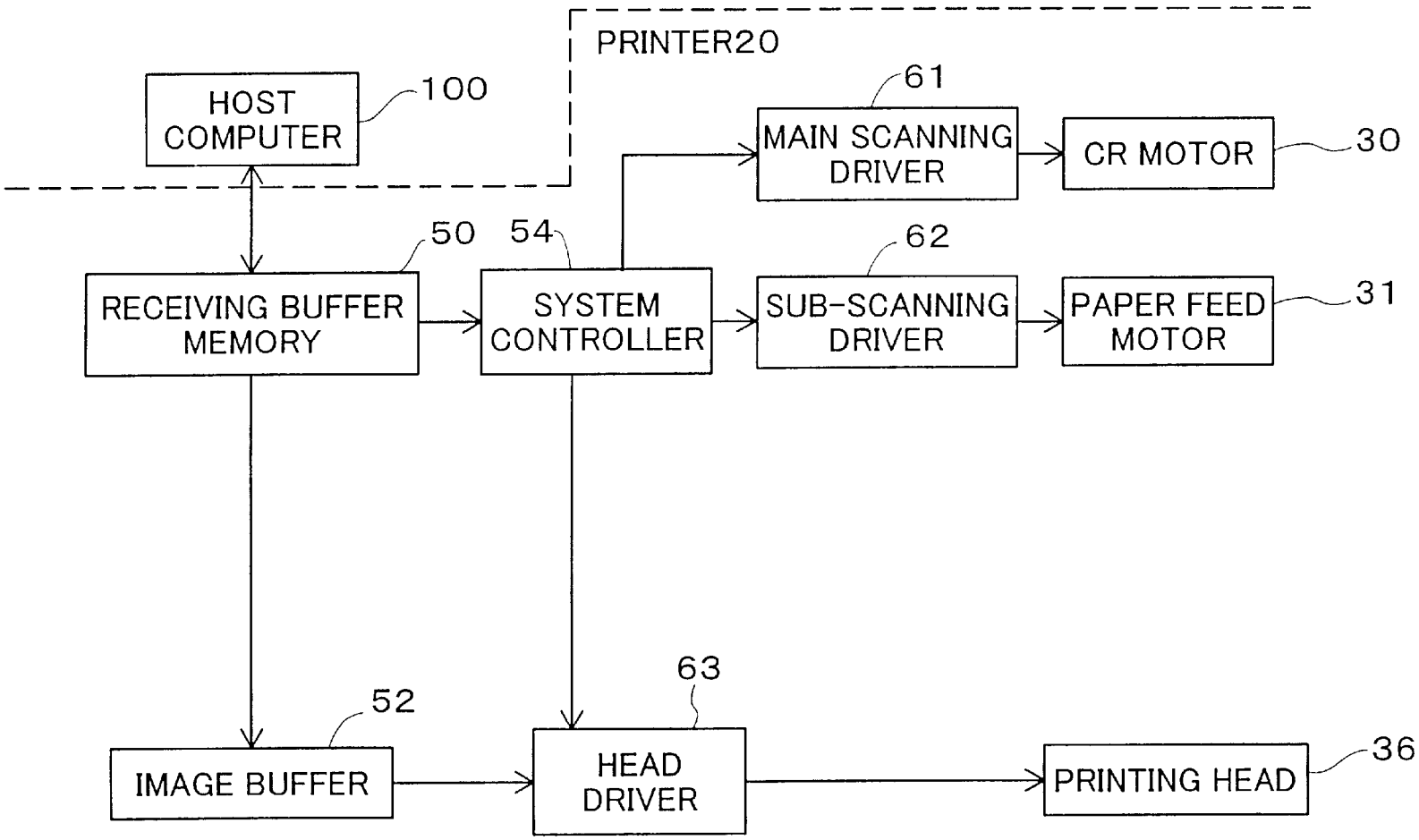
FIG. 2 is a block diagram of the electrical configuration of the printer 20.

FIG. 2 is a block diagram of the electrical configuration of the printer 20. The printer 20 comprises a receiving buffer memory 50 for receiving signals supplied from a host computer 100, an image buffer 52 for storing printing data, and a system controller 54 for controlling the overall operation of the printer 20. To the system controller 54 are connected a main scanning driver 61 for driving the carriage motor 30, a sub-scanning driver 62 for driving a paper feed motor 31, and a head driver 63 for driving the printing head 36.

The printer driver (not shown) of the host computer 100 determines the various parameters specifying the printing operation on the basis of the recording method (discussed below) designated by the user. This printer driver also produces print data for printing by this recording method on the basis of these parameters, and transfers this data to the printer 20. The transferred print data is temporarily stored in the receiving buffer memory 50. Inside the printer 20, the system controller 54 reads the required information out of the print data from the receiving buffer memory 50, and sends a control signal to the various drivers on the basis of this print data.

The image buffer 52 stores image data for a plurality of color components obtained by splitting up the print data received by the receiving buffer memory 50 into color components. The head driver 63 reads the image data for the various color components from the image buffer 52 according to the control signal from the system controller 54, and correspondingly drives the nozzle arrays for the various colors provided to the printing head 36.

B. Structure of the Printing Head

Figure 3:
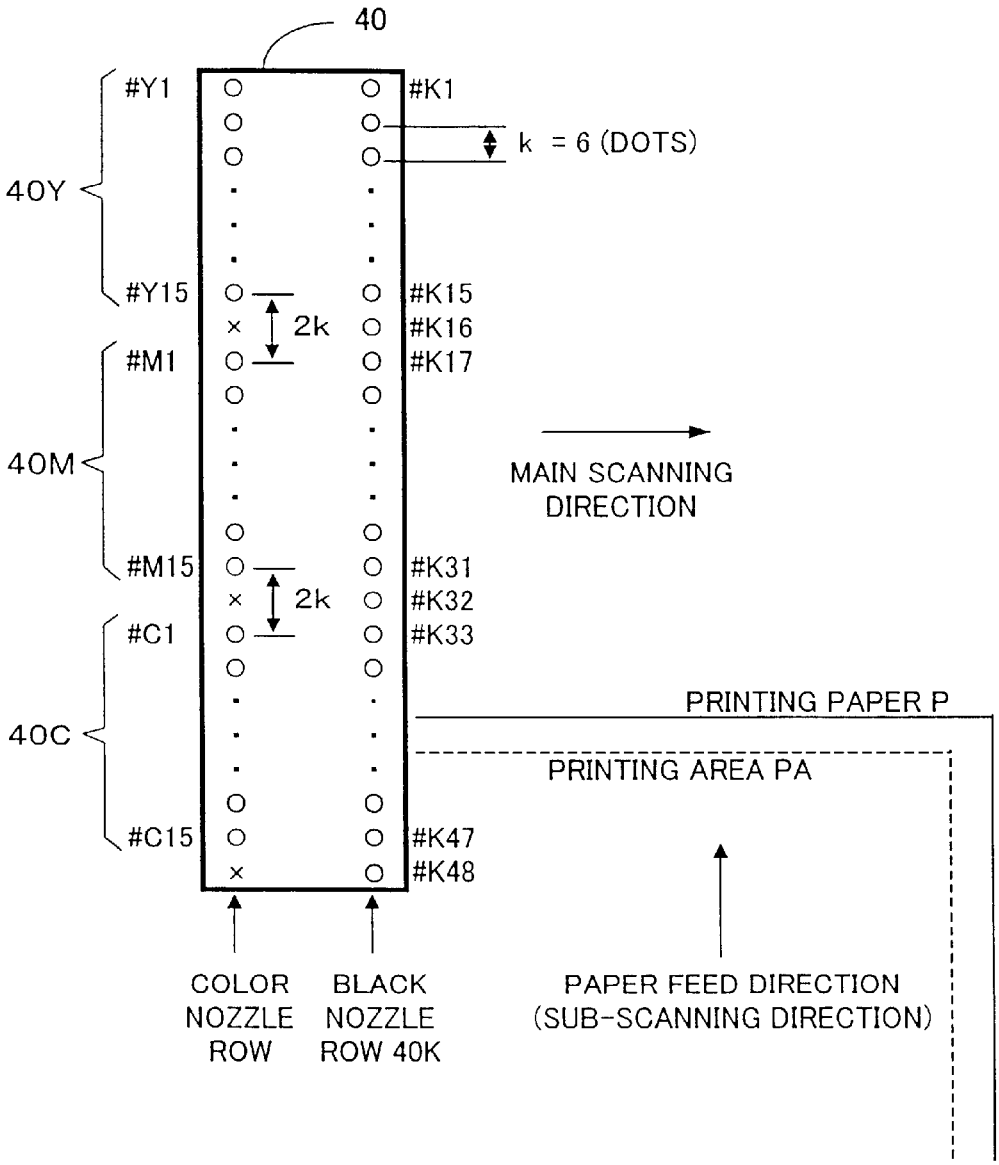
FIG. 3 is a diagram illustrating the layout of the nozzles formed on the bottom of an actuator 40.

FIG. 3 is a diagram illustrating the layout of the nozzles formed on the bottom face of the actuator 40, which is provided at the bottom of the printing head 36. A color nozzle row and a black nozzle row each arranged in a straight line in the sub-scanning direction are formed on the bottom of the actuator 40. "Actuator" as used here refers to an ink discharge mechanism including nozzles and drive elements (such as piezoelectric elements or heaters) for discharging the ink. Usually, the nozzle portion of a single actuator is integrally formed by ceramic molding. If two rows of nozzles are formed within a single actuator, the nozzles can be laid out more precisely, affording better image quality. A "nozzle row" is also called a "nozzle array" in this Specification.

The black nozzle row has 48 nozzles, #K1 to #K48. These nozzles #K1 to #K48 are laid out at a constant nozzle pitch k in the sub-scanning direction. This nozzle pitch k is 6 dots. This nozzle pitch k, however, can be set to any number that is the product of the dot pitch on the printing paper P multiplied by an integer greater than or equal to two. A "dot," which is the unit of the nozzle pitch k, refers to the minimum pitch in the sub-scanning direction of the dots formed on the printing medium.

The color nozzle row includes a yellow nozzle group 40Y, a magenta nozzle group 40M, and cyan nozzle group 40C. In this Specification, the nozzle groups used for colored inks are also called "colored nozzle groups." The yellow nozzle group 40Y has 15 nozzles, #Y1 to #Y15, and the pitch of these 15 nozzles is the same as the nozzle pitch k of the black nozzle row. The same applies to the magenta nozzle group 40M and the cyan nozzle group 40C. The "x" mark between the bottom nozzle #Y15 of the yellow nozzle group 40Y and the top nozzle #M1 of the magenta nozzle group 40M indicates that no nozzle is formed at that position. Therefore, the space between the bottom nozzle #Y15 of the yellow nozzle group 40Y and the top nozzle #M1 of the magenta nozzle group 40M is twice the nozzle pitch k. The same applies to the space between the bottom nozzle #M15 of the magenta nozzle group 40M and the top nozzle #C1 of the cyan nozzle group 40C. Put another way, the spaces between the nozzle groups used for yellow, magenta, and cyan are set to a value that is twice the nozzle pitch k.

The nozzles in the color nozzle groups 40Y, 40M, and 40C are laid out in the same sub-scanning positions as the nozzles in the black nozzle row 40K. Of the 48 nozzles #K1 to #K48 of the black nozzle row 40K, though, colored ink nozzles are not provided at corresponding positions for the sixteenth, thirty-second, and forty-eighth nozzles, #K16, #K32, and #K48.

During printing, ink droplets are discharged from the various nozzles while the printing head 36 moves in the main scanning direction along with the carriage 28 (FIG. 1). Depending on the recording method, though, not all of the nozzles are always used, and only some of them may be used.

C. Structure of the Sub-Scanning Drive Mechanisms

Figure 4:
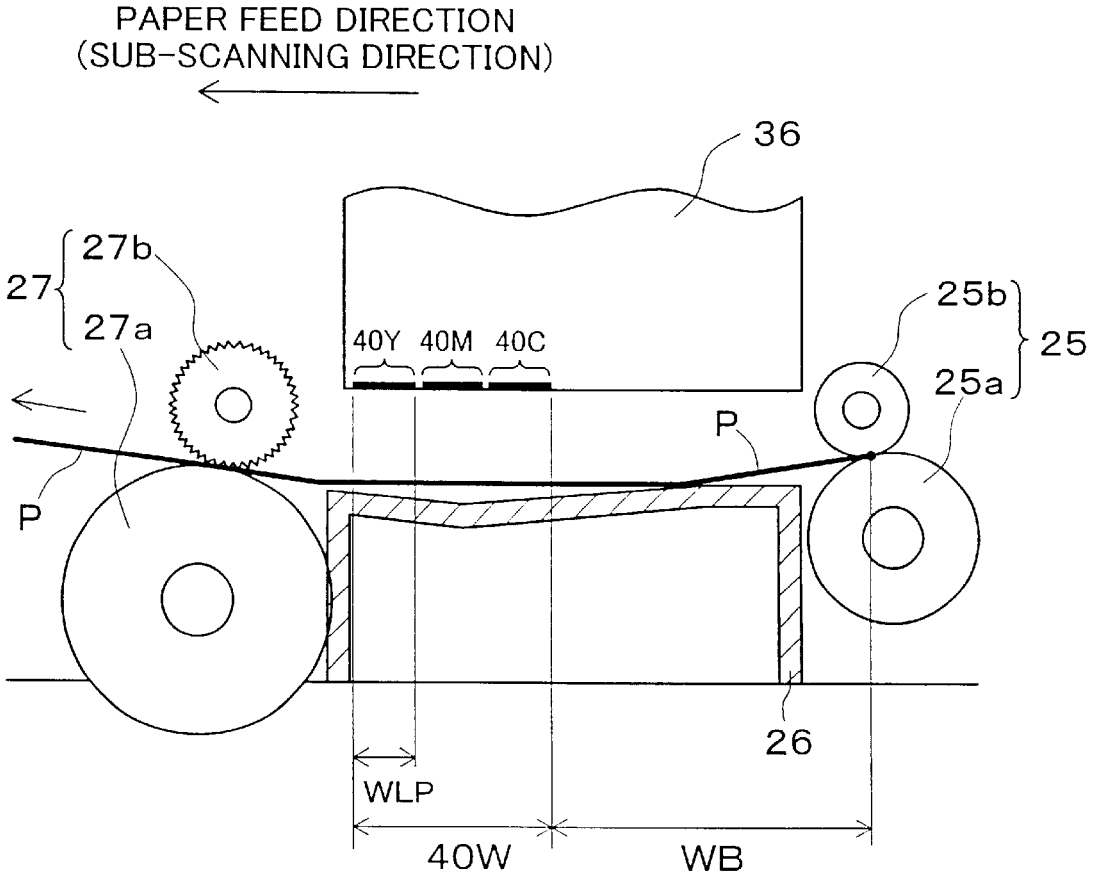
FIG. 4 is a side cross section of the sub-scanning drive mechanism for conveying the printing paper P.

FIG. 4 is a side cross-sectional view of the sub-scanning drive section for conveying the printing paper P. The sub-scanning drive section has a first sub-scanning drive mechanism 25 provided on the paper feed side, and a second sub-scanning drive mechanism 27 provided on the paper discharge side. The first sub-scanning drive mechanism 25 comprises a paper feed roller 25*a* and a follower roller 25*b*. The second sub-scanning drive mechanism 27 comprises a paper discharge roller 27*a* and a serrated roller 27*b*. These rollers 25*a*, 25*b*, 27*a*, and 27*b* are driven by transmitting the rotation of the paper feed motor 31 (FIG. 2) through a gear train (not shown). At the start of printing, the printing paper P is pinched between the rollers 25*a* and 25*b* of the first sub-scanning drive mechanism 25 from the paper feed side (the right side in FIG. 4), and conveyed by the rotation of these two rollers. When the front end of the printing paper P is pinched between the rollers 27*a* and 27*b* of the second sub-scanning drive mechanism 27, it is sent to the paper discharge side by these rollers too. After the rear end of the printing paper P has passed the pinching point of the first sub-scanning drive mechanism 25 (the point where it is pinched between the rollers 25*a* and 25*b*), the printing paper P is conveyed by the second sub-scanning drive mechanism 27 alone. An image is recorded on the printing paper P by the printing head 36 over the platen 26.

In this printer, the paper feed precision is higher with the first sub-scanning drive mechanism 25 on the paper feed side than with the second sub-scanning drive mechanism 27 on the paper discharge side. Therefore, when the paper is fed by the second sub-scanning drive mechanism 27 alone after the rear end of the printing paper P has passed the pinching point of the first sub-scanning drive mechanism 25, the feed amount precision is lower than when the paper is conveyed by the first sub-scanning drive mechanism 25.

The symbol "40W" in FIG. 4 indicates the overall width of the nozzle row in the sub-scanning direction, and the symbol "WLP" indicates the width of the yellow nozzle group 40Y. This width WLP corresponds to the width of the low precision area discussed below. The symbol "WB" indicates the distance from the pinching point of the first sub-scanning drive mechanism 25 to the rear end of the nozzle row. In this Specification, the front and rear ends of the printing paper and the nozzle rows are defined along the paper feed direction (sub-scanning direction). The paper feed direction and the sub-scanning direction are defined as the direction in which the printing paper P moves relative to the printer 20. The "front end" is also referred to as the "top," and the "rear end" as the "bottom."

D. Basic Conditions for Ordinary Recording Methods

Before describing the recording method used in an embodiment of the present invention, let us first describe the basic conditions in an ordinary recording method. In this Specification, the terms "recording method," "dot recording method," and "printing method" are synonymous.

Figures 5A, 5B:
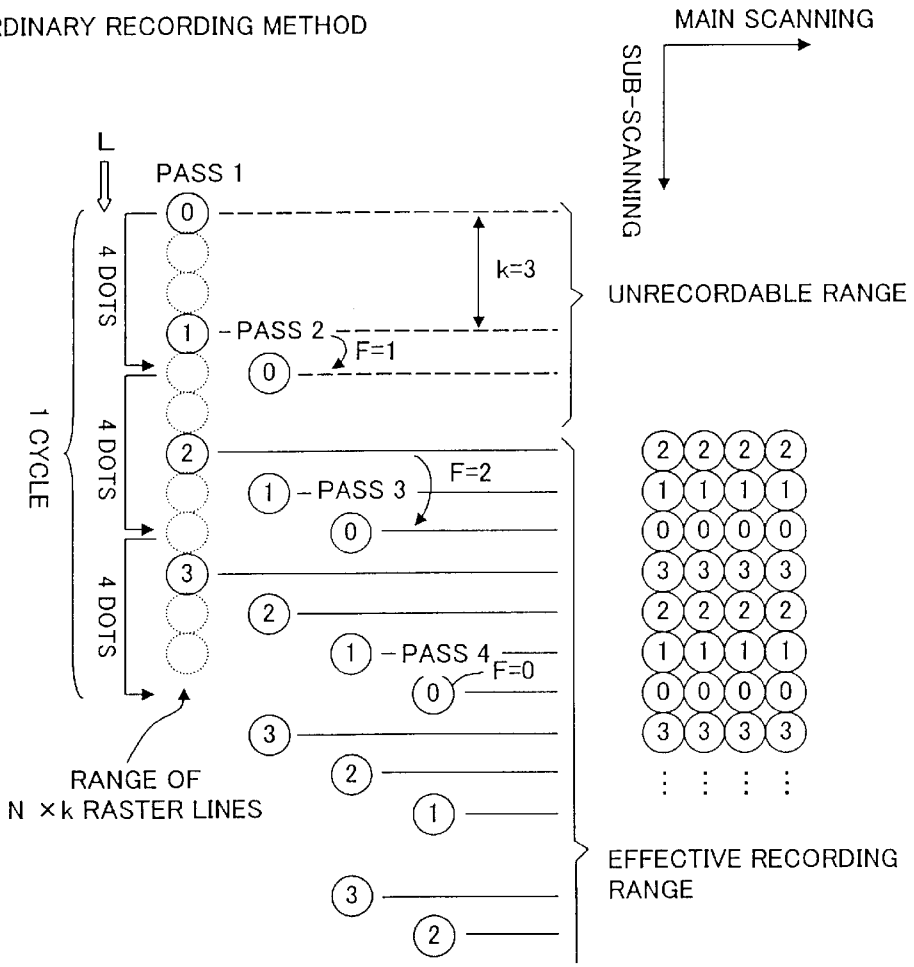
FIGS. 5(A) and 5(B) illustrate the basic conditions of a dot recording method suited to middle area processing.

FIGS. 5(A) and 5(B) illustrate the basic conditions of a dot recording method suited to middle area processing. FIG. 5(A) shows an embodiment of sub-scanning feed when four nozzles are used, and FIG. 5(B) shows the parameters of the dot recording method thereof. In FIG. 5(A), the solid circles around the numerals indicate the positions of the four nozzles in the sub-scanning direction on each pass. Here, a "pass" refers to one main scan. The numerals 0 to 3 in the circles indicate the nozzle number. The positions of the four nozzles are shifted in the sub-scanning direction every time one main scan is completed. Actually, though, the feed in the sub-scanning direction is accomplished by moving the paper with the paper feed motor 31 (FIG. 2).

In this embodiment, as shown on the left side in FIG. 5(A), the sub-scanning feed amount L is the constant value of 4 dots. Therefore, every time sub-scanning feed is performed, the positions of the four nozzles are shifted by 4 dots in the sub-scanning direction. The nozzles are used to record all the dots (also called "pixels") on a raster line during a main scan. In this Specification, the number of main scans required to record all the dots on one raster line (main scanning line) is called the "number of scan repetitions s."

The numbering of the nozzles that record the dots on each raster line is given on the right side in FIG. 5(A). At the raster lines drawn in broken lines extending to the right (main scanning direction) from the circles indicating the positions of the nozzles, recording is impossible with the raster line above and/or the raster line below, so the recording of dots is actually prohibited. Meanwhile, the raster lines drawn in solid lines extending in the main scanning direction are the range in which both the previous and following raster lines can be recorded with dots. This range in which recording can actually be performed will hereinafter be called the effective recording range (or the "effective printing range," "printing execution area," or "recording execution area").

FIG. 5(B) shows the various parameters related to this dot recording method. Parameters of a dot recording method include the nozzle pitch k (dots), the number of working nozzles N, the number of scan repetitions s, the number of effective nozzles Neff, and the sub-scanning feed amount L.

In the embodiment of FIG. 5, the nozzle pitch k is 3 dots. The number of working nozzles N is four. The number of working nozzles N is the number of nozzles actually used out of the plurality of nozzles that have been installed. The number of scan repetitions s means that dots are formed intermittently once every s dots in a single main scan. For instance, when the number of scan repetitions s is 2, dots are formed intermittently once every two dots in a single main scan. The number of scan repetitions s is also equal to the number of nozzles used in order to record all the dots on each raster line. In the case of FIGS. 5(A) and 5(B), the number of scan repetitions s is 1. The number of effective nozzles Neff can be thought of as indicating the net number of raster lines that can be recorded in a single main scan.

The table in FIG. 5(B) shows the sub-scanning feed amount L on each pass, the sum total ΣL thereof, and the offset F of the nozzles. Here, the offset F is a value indicating how many dots away the position of the nozzles is from a reference positions in the sub-scanning direction on each subsequent pass, assuming that the periodic positions of the nozzles on the first pass (every four dots in FIG. 5(A)) is the reference positions with an offset of zero. For example, as shown in FIG. 5(A), the positions of the nozzles move by the sub-scanning feed amount L (4 dots) in the sub-scanning direction after the first pass. Meanwhile, the nozzle pitch k is 3 dots. Therefore, the offset F of the nozzles on the second pass is 1 (see FIG. 5(A)). Similarly, the positions of the nozzles on the third pass is shifted from the initial positions by ΣL=8 dots, and the offset F thereof is 2 consequently. The positions of the nozzles on the fourth pass is shifted from the initial positions by ΣL=12 dots, and the offset F thereof is 0. Since the offset F of the nozzles returns to zero on the fourth pass after three sub-scanning feeds, three sub-scans is termed one cycle, and all the dots on the raster lines within the effective recording range can be recorded by repeating this cycle over and over.

As can be seen from the example in FIGS. 5(A) and 5(B), the offset F is zero when the position of the nozzles has moved away from the initial position by an integer multiple of the nozzle pitch k. Also, the offset F is given by the remainder (ΣL)%k of dividing the sum total ΣL of the sub-scanning feed amount L by the nozzle pitch k Here, "%" is an operator indicating the taking of the remainder of division. If the initial positions of the nozzles are thought of part of periodic positions, then the offset F can be thought of as indicating the amount of phase shift from the initial positions of the nozzles.

When the number of scan repetitions s is 1, the following conditions must be met so that there will be no missing or overlapping raster lines in the effective recording range.

Condition c1: The number of sub-scanning feeds in one cycle is equal to the nozzle pitch k.

Condition c2: The offset F of the nozzles after each sub-scanning feed in one cycle is a different value each time within a range of 0 to (k−1).

Condition c3: The average feed amount of a sub-scan (ΣL/k) is equal to the number of working nozzles N. In other words, the sum total ΣL of the sub-scanning feed amount L per cycle is equal to the product (N×k) of the number of working nozzles N multiplied by the nozzle pitch k.

The above conditions can be understood by thinking of them in the following way. Since there are (k−1) raster lines between adjacent nozzles, in order to return to the reference positions of the nozzles (the position where the offset F is zero) by performing recording on these (k−1) raster lines in one cycle, the number of sub-scanning feeds in one cycle is k times. If there are fewer than k sub-scanning feeds in one cycle, there will be missing portions in the recorded raster lines, but if there are more than k sub-scanning feeds in one cycle, there will be overlap in the recorded raster lines. Therefore, the above-mentioned first condition c1 is established.

When there are k sub-scanning feeds per cycle, missing portions and overlap in the recorded raster lines will be eliminated only when the values of the offset F after sub-scanning feed the various times are mutually different within the range of 0 to (k−1). Therefore, the above-mentioned second condition c2 is established.

If the above first and second conditions are met, the recording of k raster lines by N number of nozzles will be performed during one cycle. Therefore, in one cycle N×k raster lines will be recorded. Meanwhile, if the above-mentioned third condition c3 is met, as shown in FIG. 5(A), the position of the nozzles after one cycle (after k times of sub-scanning feed) will come to a position N×k raster lines away from the initial nozzle position. Therefore, satisfying the above-mentioned first to third conditions c1 to c3 allows missing portions and overlap to be eliminated in the recorded raster lines.

Any integer of at least 2 can be also used as the number of scan repetitions s. For instance, when the number of scan repetitions s is 2, the odd-numbered dot positions will be recorded in the first main scan on a particular raster line, while the even-numbered dot positions will be recorded on the second main scan. Hereinafter, a dot recording method in which the number of scan repetitions s is at least 2 will be called the "overlap method."

With the overlap method, the above-mentioned first to third conditions c1 to c3 are rewritten as the following conditions c1' to c3'.

Condition c1': The number of sub-scanning feeds in one cycle is equal to the product of the nozzle pitch k multiplied by the number of scan repetitions s, that is (k×s).

Condition c2': The offset F of the nozzles after each sub-scanning feed in one cycle is a different value each time within a range of 0 to (k−1), and the various values are repeated s times each.

Condition c3': The average feed amount of a sub-scan {ΣL/(k×s)} is equal to the number of effective nozzles Neff (=N/s). In other words, the sum total ΣL of the sub-scanning feed amount L per cycle is equal to the product (Neff×(k×s))

of the number of effective nozzles Neff multiplied by the number of sub-scanning feeds (k×s).

The above conditions c1' to c3' also holds when the number of scan repetitions s is 1. Therefore, conditions c1' to c3' generally hold in the dot recording method regardless of the number of scan repetitions s. Specifically, if the above three conditions c1' to c3' are met, then missing portions or overlap in the recorded dots can be eliminated in the effective recording range. However, when an overlap method is employed (when the number of scan repetitions s is 2 or more), an additional condition is that the recording positions of the nozzles recording the same raster line be mutually shifted in the main scanning direction.

Depending on the recording method, partial overlap is also sometimes performed. "Partial overlap" refers to a recording method in which there are some raster lines recorded with one nozzle as well as other raster lines recorded with a plurality of nozzles. The number of effective nozzles Neff can also be defined in a recording method in which this partial overlap is used. For instance, with a partial overlap method in which two of the four nozzles work together to record the same raster line and the remaining two nozzles each record one raster line, the number of effective nozzles Neff is three. The three conditions c1' to c3' discussed above are valid in the case of this partial overlap method as well.

The number of effective nozzles Neff can also be thought of as indicating the net number of raster lines that can be recorded with a single main scan. For instance, when the number of scan repetitions s is 2, a number of raster lines equal to the number of working nozzles N can be recorded with two main scans, so the net number of raster lines that can be recorded with a single main scan is equal to N/s (that is, Neff).

In the example of FIGS. 5(A) and 5(B), the sub-scanning feed amount L was set to a constant value of 4 dots, but it is also possible to use a combination of a plurality of different feed amounts instead. Here again, if the scanning parameters are set so that the above-mentioned conditions c1' to c3' are met, then missing portions and overlap can be eliminated from the recorded dots.

E. Concept of Recording Method in Top Processing and Bottom Processing

Figures 6A, 6B:
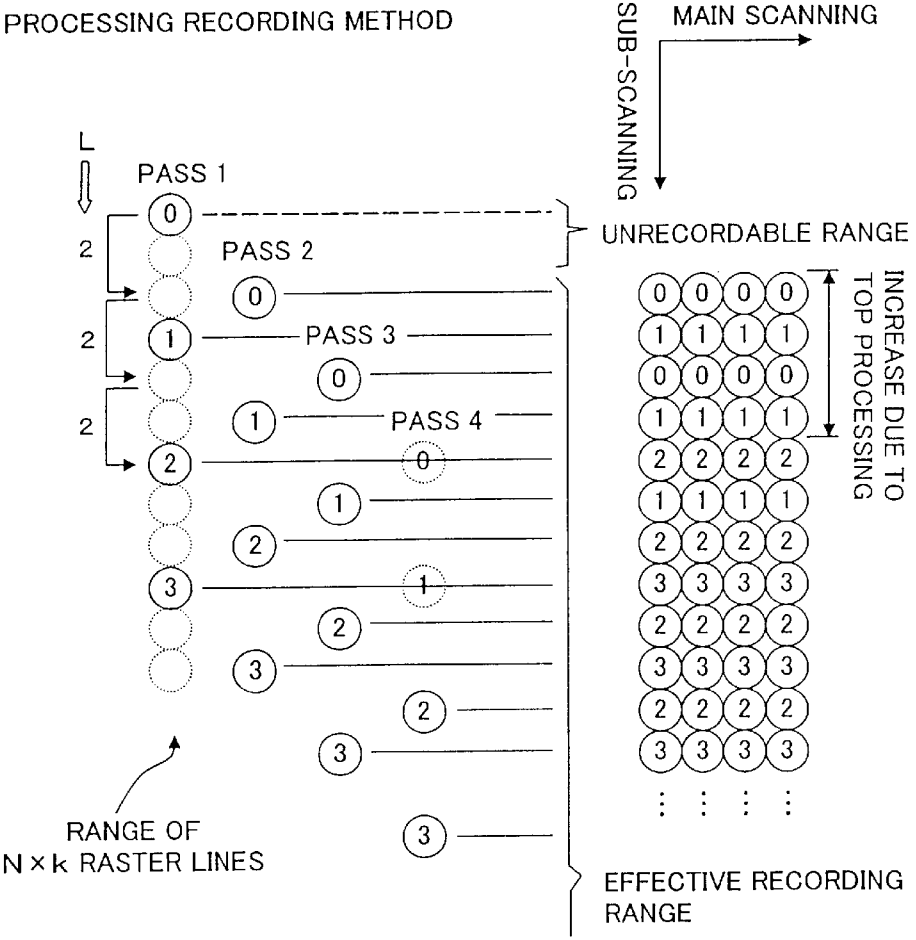
FIGS. 6(A) and 6(B) illustrate the concept of a recording method in the vicinity of the top of the printing paper.

FIGS. 6(A) and 6(B) illustrate the concept of a recording method in the vicinity of the top of the printing paper. In this Specification, special print processing in the vicinity of the top of the printing paper is called "top processing," and special print processing in the vicinity of the bottom of the printing paper is called "bottom processing."

As shown in FIGS. 5(A) and 5(B) discussed above, there is a range in which dot recording effectively cannot be executed (unrecordable range) in the vicinity of the top of the printing paper. In view of this, the sub-scanning feed amount is set smaller in the top processing, which reduces the unrecordable range and increases the effective recording range. More specifically, with the top processing shown in FIG. 6(A), the sub-scanning feed amount L is set to 2 dots, which is smaller than the sub-scanning feed amount L(=4 dots) in the ordinary recording method shown in FIGS. 5(A) and 5(B). It can be seen that as a result, the effective recording range is increased by 4 raster lines over the situation in FIG. 5(A).

On the fourth pass in FIG. 6(A), the $0^{th}$ nozzle and the $1^{st}$ nozzle do not execute dot recording. The reason for this is that, as shown in FIG. 6(A), with top processing, it is permissible for there to be some overlap of the raster lines to be recorded by the working nozzles.

In general, with a recording method that employs top processing, the sub-scanning feed amount is set smaller than with the recording method employed in the middle area of the printing paper (the area excluding the vicinities of the top and bottom), and this expands the effective recording range. Also in bottom processing, a recording method is applied that makes use of a smaller sub-scanning feed amount than in the recording method employed in the middle area of the printing paper, which expands the effective recording range. Since the concept behind bottom processing is substantially the same as that of top processing, the details thereof will not be described here.

There are also times when irregular feed is employed in the middle area (a feed method in which a plurality of different feed amounts are used). It is also possible to employ irregular feed in top processing or bottom processing. In this case, the average sub-scanning feed amount in top processing is set to a smaller value than the average sub-scanning feed amount in middle area processing. The same applies to bottom processing. The phrase "a small sub-scanning feed amount" has a broad meaning that includes a case such as this.

F. Concept of Application of Recording Method in Embodiments

Figure 7B:
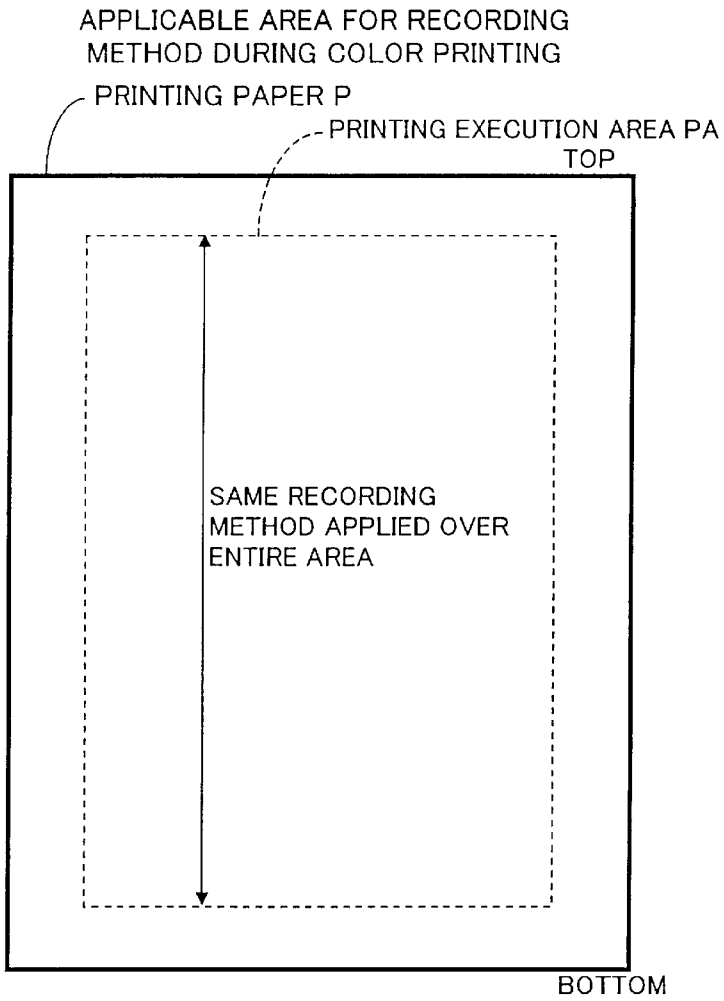
FIGS. 7(A) and 7(B) illustrate the concept of a recording method during color printing and monochromatic printing.
Figure 7A:
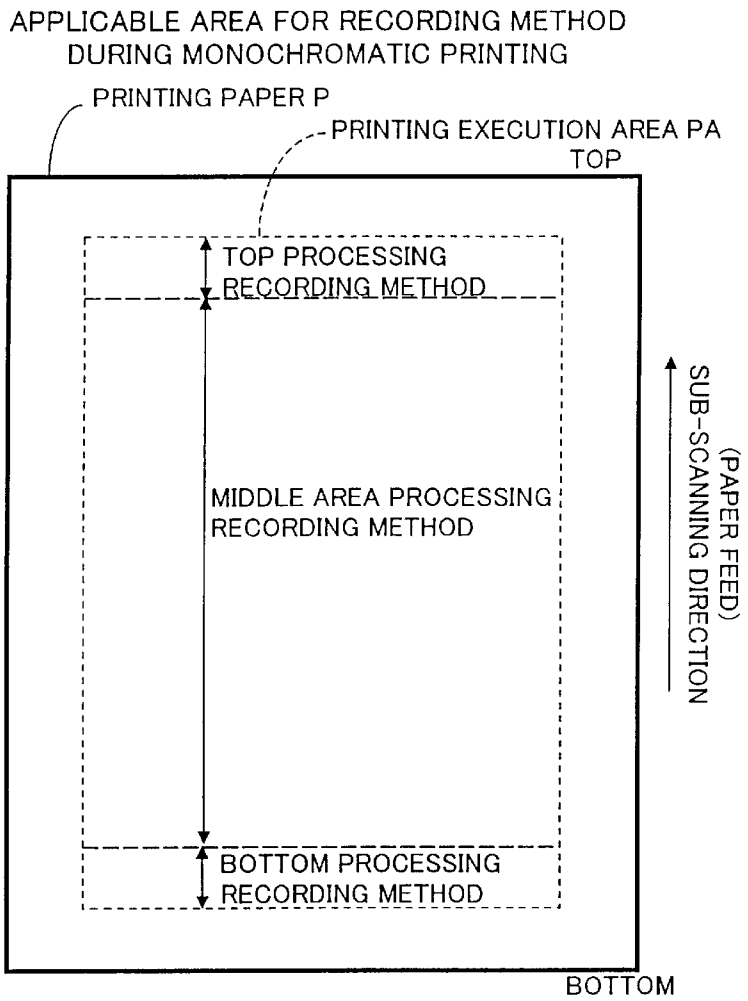

FIGS. 7(A) and 7(B) illustrate the concept of a recording method during color printing and monochromatic printing. As shown in FIGS. 7(A) and 7(B), a printing execution area PA in which printing is actually executed is set on the printing paper P. However, the printing execution area during color printing is not necessarily the same as the printing execution area during monochromatic printing.

As shown in FIG. 7(A), during monochromatic printing, a recording method for middle area processing is applied to the middle area of the printing execution area PA. This recording method for middle area processing satisfies the above-mentioned conditions c1' to c3', and is a recording method with which there is no overlap or missing portions in the recorded dots. A recording method for top processing or bottom processing is applied in the vicinity of the top or the vicinity of the bottom of the printing execution area PA, respectively. During color printing, meanwhile, as shown in FIG. 7(B), the same recording method is applied over the entire printing execution area PA. This recording method satisfies the above-mentioned conditions c1' to c3', and is a recording method with which there is no overlap or missing portions in the recorded dots. The specific details of the recording methods illustrated in FIGS. 7(A) and 7(B) will be discussed below.

In this embodiment, the reason for applying different recording methods during monochromatic printing and color printing is as follows. As shown in FIG. 3, with the printing head in this embodiment, the number of black nozzles (48) is approximately three times the number of the various colored nozzles (15). During monochromatic printing, printing is executed using virtually all 48 of the black nozzles. During color printing, on the other hand, the same number of nozzles are used for the various colors of CMYK. Therefore, in regard to the number of working nozzles N out of the scanning parameters described with FIGS. 5(A) and 5(B), the number of working nozzles in monochromatic printing is approximately three times the number of working nozzles during color printing. Incidentally, the unrecordable range described with FIGS. 5(A) and 5(B) tends to be larger when more nozzles are used. With this embodiment, since the number of working nozzles N is larger in monochromatic printing than in color printing, the unrecordable range is larger in monochromatic printing. In view of this, it is preferable in monochromatic printing to reduce the unrecordable range and expand the effective recording range by performing top processing and bottom processing. In color printing, though, the unrecordable range is relatively small, so there is little need to perform top processing or bottom processing. If top and bottom processing are not performed, there is no need for the special print processing that these would otherwise require, an advantage of which is that the overall print processing is simpler.

Thus, with this embodiment, when a printing mode is selected from among monochromatic printing and color printing, printing is executed according to the recording method best suited to that printing mode.

G. Specific Examples of Recording Methods for Color Printing

FIG. 8 shows the scanning parameters in the recording method applied in the embodiment of color printing. With this recording method, the nozzle pitch k is 6 dots, the number of scan repetitions s is 1, and the number of working nozzles N is 13. The table at the bottom of FIG. 8 shows the parameters related to the various passes, from the first to the seventh. This table gives for each pass the feed amount L for sub-scanning executed immediately prior to that pass, the sum total ΣL thereof, and the offset F. The sub-scanning feed amount L is a constant value of 13 dots. A recording method (scanning method) such as this in which the sub-scanning feed amount L is a constant value is called "regular feed." It is also possible to employ a recording method of irregular feed in which a series of different values are used as the sub-scanning feed amount L. The scanning parameters in FIG. 8 satisfy the above-mentioned conditions c1' to c3'.

Figure 9:
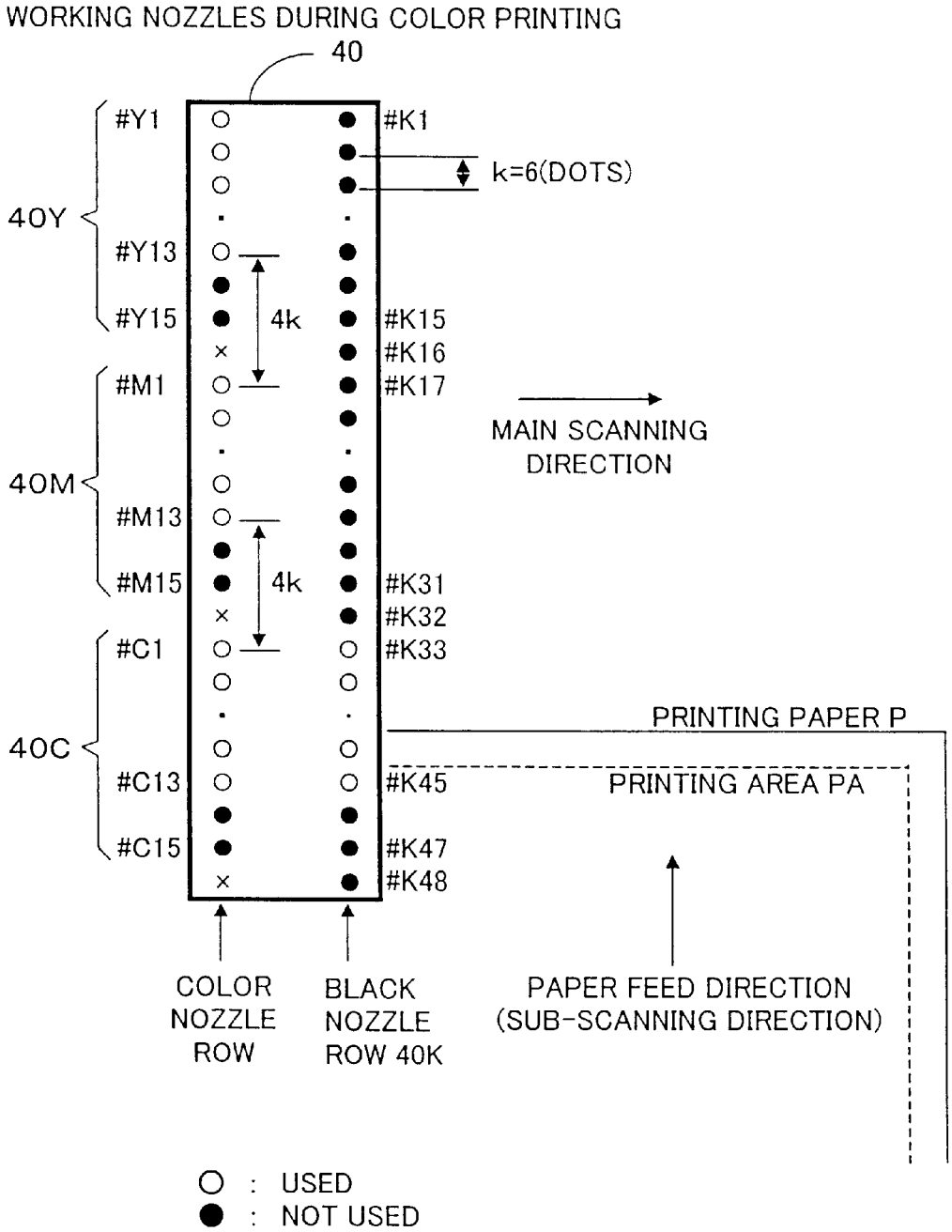
FIG. 9 shows the nozzles used in an embodiment of color printing.

FIG. 9 shows the nozzles used in the embodiment of color printing. The actuator 40 in FIG. 9 is the same as that shown in FIG. 3, but during color printing only about a third of the 48 black nozzles are used. In FIG. 9, the white circles indicate nozzles used during color printing in this embodiment, while the black circles indicate nozzles that are not used. Specifically, for colored nozzles, the first 13 of the 15 nozzles of each color are used. For black ink, only the 13 nozzles in the same sub-scanning position as the nozzles #C1 to #C13 used for cyan are used. If the same number of nozzles is thus used for the four types of ink, then dots of four types of ink can be formed without any overlap or missing portions by executing scanning in accordance with the common scanning parameters shared by the different types of ink.

In this Specification, the nozzle group used for each ink and made up of the nozzles that are used is also called a "working nozzle group." The nozzle group used for each ink and provided to the actuator 40 is also called an "installed nozzle group."

Nozzles that are contiguously lined up at the nozzle pitch k are selected as the working nozzles used for each ink. The space between the bottom nozzle #Y13 of the yellow working nozzle group and the top nozzle #M1 of the magenta working nozzle group is 4 k (that is, 24 dots). Similarly, the space between the bottom nozzle #M13 of the magenta working nozzle group and the top nozzle #C1 of the cyan working nozzle group is also 4 k.

FIG. 10 shows which nozzles record the raster lines within the effective recording range in the various passes during color printing in this embodiment. On pass 1, the three cyan nozzles #C11 to #C13 execute dot recording on the first, seventh, and thirteenth effective raster lines, respectively. "Effective raster lines" means the raster lines within the effective recording range. In FIG. 10, the number sign (#) has been omitted from in front of the nozzle numbers. The hatched nozzles indicate unused nozzles. The "x" symbols indicate the positions where there are no nozzles in between adjacent installed nozzle groups.

On pass 2, the recording position of the actuator 40 on the printing paper is moved by 13 dots in the sub-scanning direction from pass 1. In this embodiment, the nozzle pitch k is 6, so the offset F of the nozzle position after this sub-scanning feed (the remainder or dividing the sum total ΣL of the feed amounts L by k) is 1 dot. Therefore, what is recorded on pass 2 appears to be one raster line lower than the raster line that was recorded on pass 1. Naturally, it is actually the raster line that is 13 lines lower than what was recorded. In color printing in this embodiment, the sub-scanning feed amount L is a constant value of 13 dots, so it appears that the position of the raster line being recorded moves down one line every time sub-scanning feed is performed.

With respect to the cyan ink, as will be described below, the sum total of the sub-scanning feed error is at its largest at a position Cmis between the sixth and seventh raster lines. The sixth raster line is recorded on pass 6, while the seventh raster line is recorded on pass 1. Therefore, sub-scanning feed is performed five times between pass 1, in which the seventh raster line is recorded, and pass 6, in which the sixth raster line is recorded. Therefore, five passes' worth of sub-scanning feed error accumulates between the sixth and seventh raster lines. Similarly, five passes' worth of sub-scanning feed error accumulates between the twelfth and thirteenth raster lines with respect to cyan ink.

Along the same line of thinking, with respect to the magenta ink, the sum total of sub-scanning feed error can be seen to be relatively large at a position Mmis between the seventh and eighth raster lines. Also, with respect to the yellow ink, the sum total of sub-scanning feed error is relatively large at a position Ymis between the ninth and tenth raster lines. Hereinafter, these positions where the sum total of sub-scanning feed error is relatively large will be called "error accumulation positions."

As will be understood from the above description, with color printing in this embodiment, the error accumulation positions are different for the various colored inks, and never coincide. Banding (streaked portions of inferior image quality extending in the main scanning direction) tends to occur at error accumulation positions. With this embodiment, however, since the error accumulation position is different for each of the colored inks, banding will not be pronounced at these positions.

In order to keep the error accumulation positions from coinciding as much as possible for nozzle groups that are adjacent in the sub-scanning direction, it is generally preferable to select the working nozzles such that the space between adjacent working nozzle groups is M times the nozzle pitch k where M is an integer of at least 2.

Figure 11:
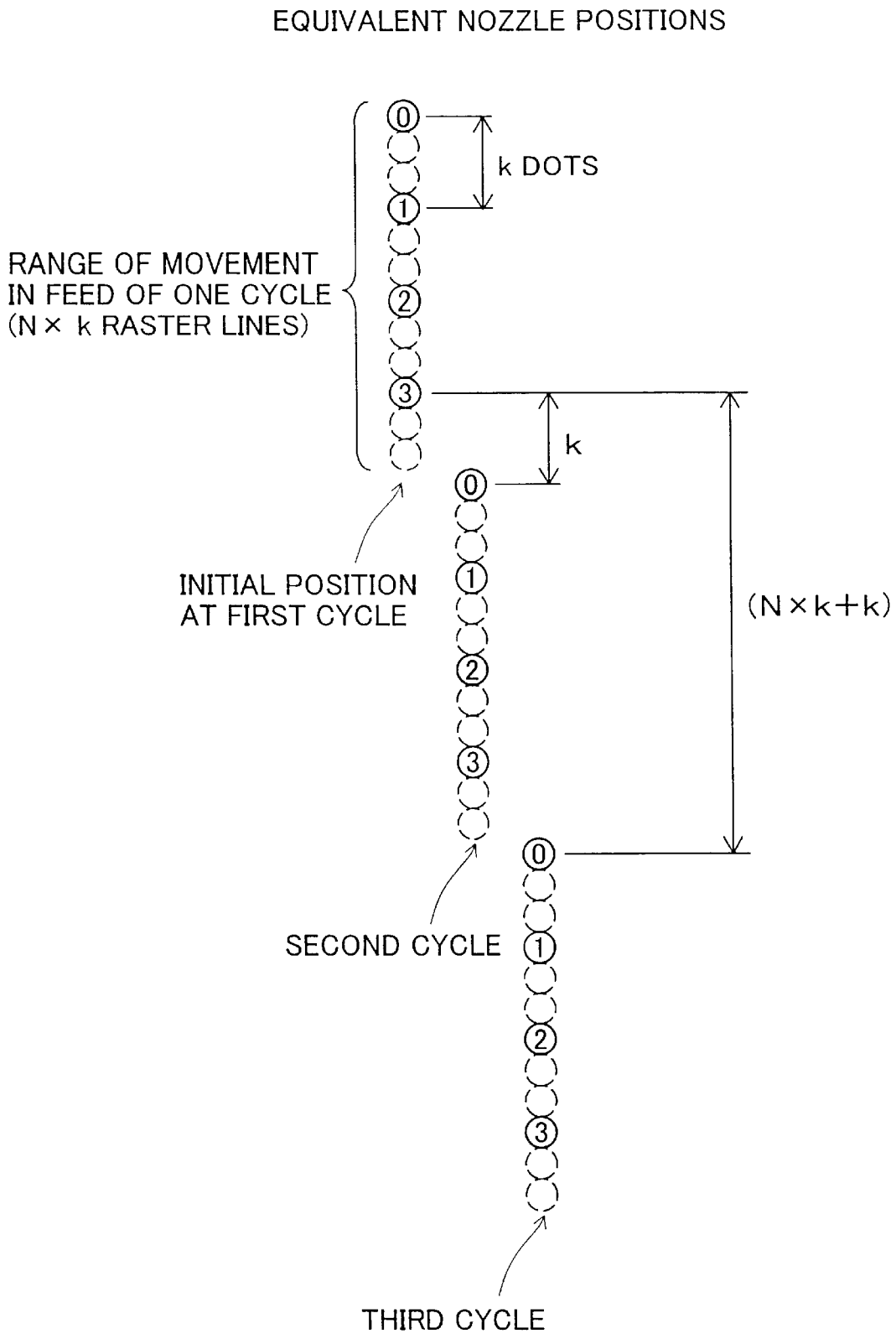
FIG. 11 is a diagram illustrating equivalent nozzle positions.

It is also preferable, though, for the space between adjacent working nozzle groups in the sub-scanning direction to be set as follows. FIG. 11 is a diagram illustrating equivalent nozzle positions in the ordinary recording method shown in FIGS. 5(A) and 5(B). As described for FIGS. 5(A) and 5(B), when the number of scan repetitions s is 1, the scanning in one cycle includes k times of sub-scanning feed. Therefore, the amount of movement of a nozzle group in one cycle of sub-scanning feed is N×k raster lines. FIG. 11 shows the initial positions of the nozzle groups in the first to third cycles. Since the same recording operation is executed from these three nozzle group positions, these positions are mutually equivalent. The space between the bottom nozzle at the initial position in the first cycle and the top nozzle at the initial position in the second cycle is k dots. The space between the bottom nozzle at the initial position in the first cycle and the top nozzle at the initial position in the third cycle is (N×k+k) dots. Although not shown in this Figure, the space between the bottom nozzle at the initial position in the first cycle and the top nozzle at the initial position in the fourth cycle is (2×N×k+k) dots. Generally, the space between the bottom nozzle at the initial position in the first cycle and the top nozzle of an equivalent nozzle group is expressed as (N×n+1)k dots. Here, n is any integer of at least 0.

If working nozzle groups of different colors should happen to be disposed at equivalent nozzle group positions as shown in FIG. 11, then the error accumulation positions related to these inks will coincide with each other. In order to avoid this situation, the space between adjacent working nozzle groups should be set to a value other than (N×n+1)k dots where N is the number of working nozzles, and n is an integer of at least 1. The reason that n here is at least 1, rather than at least 0, is that the case of n=0 is excluded if the space between adjacent nozzle groups is set to M times the nozzle pitch k where M is an integer of at least 2 as described before.

The recording method for color printing as discussed above is characterized as follows. As can be seen from FIG. 9 discussed above, the black nozzle row 40K is ahead of the color nozzle rows during main scanning, so in color printing, black dots will be formed on the printing paper before dots of the other inks. Also, the color nozzle rows are laid out in the order of the cyan nozzle group 40C, the magenta nozzle group 40M, and the yellow nozzle group 40Y in the sub-scanning direction, and the colored dots are formed in this order. Furthermore, only those nozzles at the same sub-scanning positions as the cyan working nozzle group at the rear end in the sub-scanning direction are used as the black working nozzle group.

The above characteristics of the actuator 40 result in the following various advantages in color printing of this embodiment. The first advantage is that black dots are formed before the dots of other inks. If the black dots were instead formed after the dots of other inks, the black ink would tend to bleed and diminish the saturation of the color image. In particular, saturation tends to decrease markedly if black ink and yellow ink bleed together. In view of this, the saturation of a color image can be enhanced if the black dots are formed before the dots of other inks at any position within the printing execution area PA by selecting the working nozzle groups as shown in FIG. 9.

The second advantage is that the yellow dots are formed after the dots of other inks at some position within the printing execution area PA. As can be understood from FIG. 9, when the printing paper P is conveyed in the sub-scanning direction, first of all black dots and cyan dots are formed in that order at any position within the printing execution area PA, then magenta dots are formed, and finally yellow dots are formed. Nevertheless, as shown in FIG. 4, after the rear end of the printing paper P has passed the pinch point of the first sub-scanning drive mechanism 25 (the contact point of the rollers 25*a* and 25*b*), sub-scanning feed is only performed by the second sub-scanning drive mechanism 27, which has relatively low precision. As a result, as will be described below, sub-scanning feed is performed at a relatively low precision in the formation of yellow dots in the low precision area having the same width as the width WLP of the yellow nozzle group 40Y.

Figure 12:
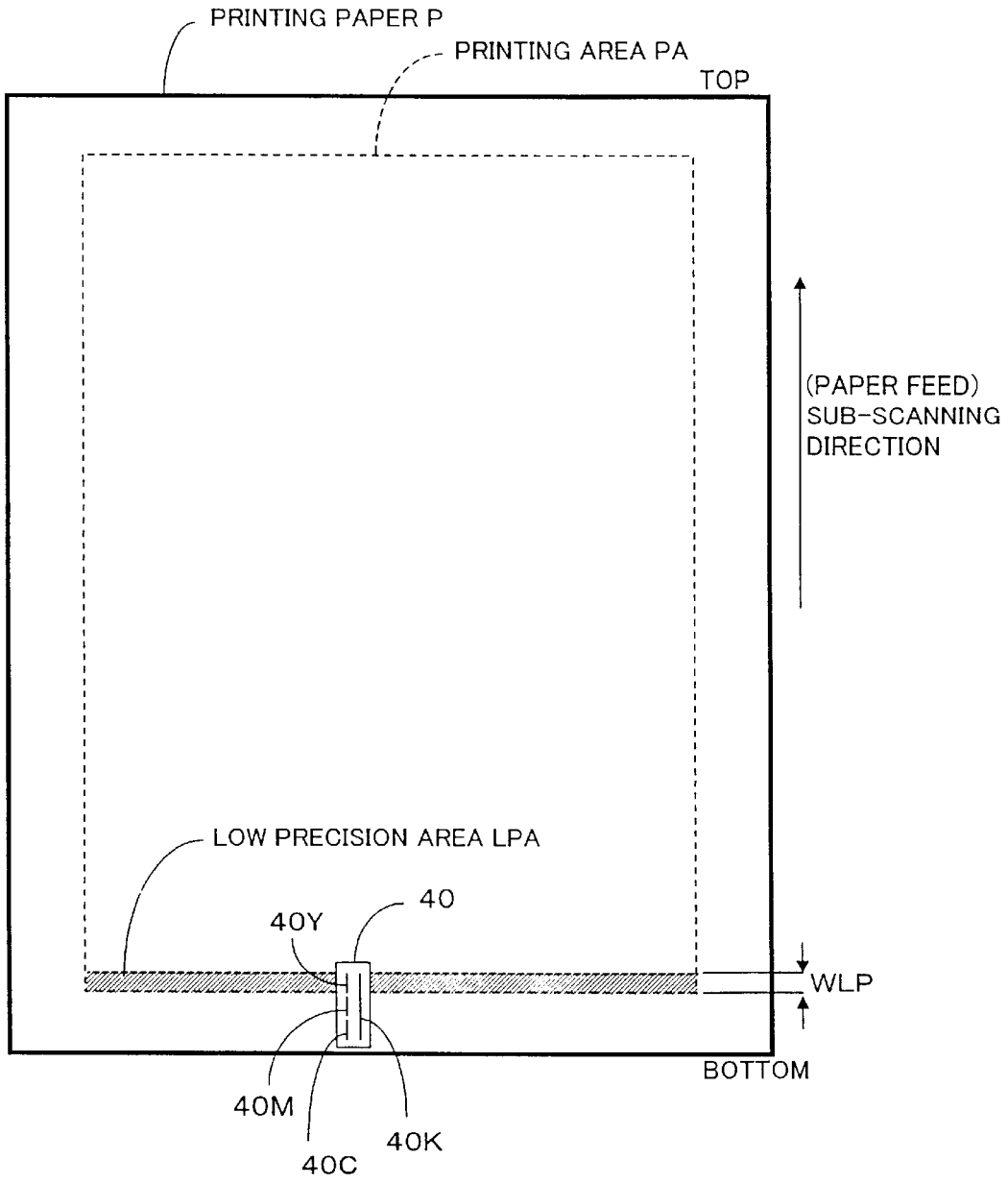
FIG. 12 a diagram illustrating the relation between the actuator 40 and the low precision area LPA present at the rear end of the printing paper P.

FIG. 12 is a diagram illustrating the relation between the actuator 40 and the low precision area LPA present at the rear end of the printing paper P. When yellow dots are formed in the low precision area LPA present at the rear end of the printing execution area PA, sub-scanning feed is performed at relatively low precision by the second sub-scanning drive mechanism 27. Here, the "low precision area LPA" refers to an area in which the sub-scanning feed precision is low. The width of the low precision area LPA is equal to the width of the yellow nozzle group 40Y measured in the sub-scanning direction.

At the point in time of FIG. 12, the formation of black, magenta, and cyan dots within the low precision area LPA has been completed. Therefore, beyond the point in time of FIG. 12 only yellow dots are formed in the low precision area LPA. In general, though, a property of yellow dots is that they stand out less than dots of the other three colors. Accordingly, even if the sub-scanning feed precision is low and there is a certain amount of deviation in the position of the yellow dots, there will be little deterioration in image quality. Specifically, in the color printing of this embodiment, when sub-scanning feed is performed by just the second sub-scanning drive mechanism 27, only yellow dots are formed in the low precision area LPA, so an advantage is that there is little deterioration in image quality even in the low precision area LPA.

In terms of minimizing deterioration of image quality due to low-precision sub-scanning feed, there is no need to limit the procedure so that only yellow dots are formed in the low precision area LPA, and what is important is that dots of other colors be formed as little as possible. For instance, when low-precision sub-scanning feed is performed, it is preferable to control the operation of the various nozzles so that yellow dots will account for at least half of the dots formed.

In FIG. 5(B), top processing was not performed during color printing, but top processing may indeed be executed. In other words, the same recording method should at least be applied both in the vicinity of the rear end and in the middle area of the printing execution area during color printing. The reason for this is that there is no advantage to forming the yellow dots in the low precision area LPA as discussed above in the vicinity of the top of the printing paper.

H. Specific Examples of Recording Methods of Monochromatic Printing

FIG. 13 shows the scanning parameters in the middle area processing during monochromatic printing in this embodiment. With this recording method, the nozzle pitch k is 6 dots, the number of scan repetitions s is 1, and the number of working nozzles N is 47.

The table at the bottom of FIG. 13 shows the parameters related to the various passes, from the first to the seventh. A constant value of 47 dots is used as the sub-scanning feed amount. It is also possible to employ irregular feed as the sub-scanning feed. The scanning parameters in FIG. 13 also satisfy the above-mentioned conditions c1' to c3'. FIG. 14 shows which nozzles record the raster lines within the effective recording range in the various passes in the middle area processing during monochromatic printing.

FIG. 15 shows the scanning parameters in the top processing during monochromatic printing in this embodiment. As shown in the table at the bottom of FIG. 15, passes 1 to 6 correspond to the top processing. A constant value of 5 dots is used as the sub-scanning feed amount L in the top processing.

FIGS. 16 and 17 show which nozzles record the raster lines within the effective recording range in the various passes in the top processing during monochromatic printing. FIG. 16 shows the first to fifth raster lines of the effective recording range, while FIG. 17 shows the $256^{th}$ to $306^{th}$ raster lines of the effective recording range. In FIGS. 16 and 17, the crossed-out boxes containing nozzle numbers indicate that those nozzles were not used. It can be seen that some of the 47 nozzles used in the middle area processing are not used from pass 1 to pass 5, which is main scanning in the top processing.

FIG. 18 shows the raster line numbers to which the various nozzles are assigned for recording in the various passes in the top processing during monochromatic printing. In this Figure, "n/a" means that the nozzle is not used in that pass. For example, in pass 1, nozzles #1 to #4 and nozzles #13 to #47 are not used. In the top processing, the number of nozzles actually used is adjusted for every pass. In the middle area processing from pass 7 on, however, 47 nozzles are always used. Performing the top processing in this way makes it possible to expand the effective recording range as described in FIG. 6.

FIG. 19 shows the scanning parameters in the bottom processing during monochromatic printing in this embodiment. Pass 0 in the table at the bottom of FIG. 19 means that this is the last main scan. Also, pass −11, for example, means that this is the 11th pass prior to the last pass 0 . The six passes from pass −5 to pass 0 correspond to the bottom processing. On the first pass of the bottom processing, or pass −5, the sub-scanning feed amount L is set to 15 dots, but from pass −4 to pass 0 , the sub-scanning feed amount L is set to a constant value of 5 dots.

Figure 20:
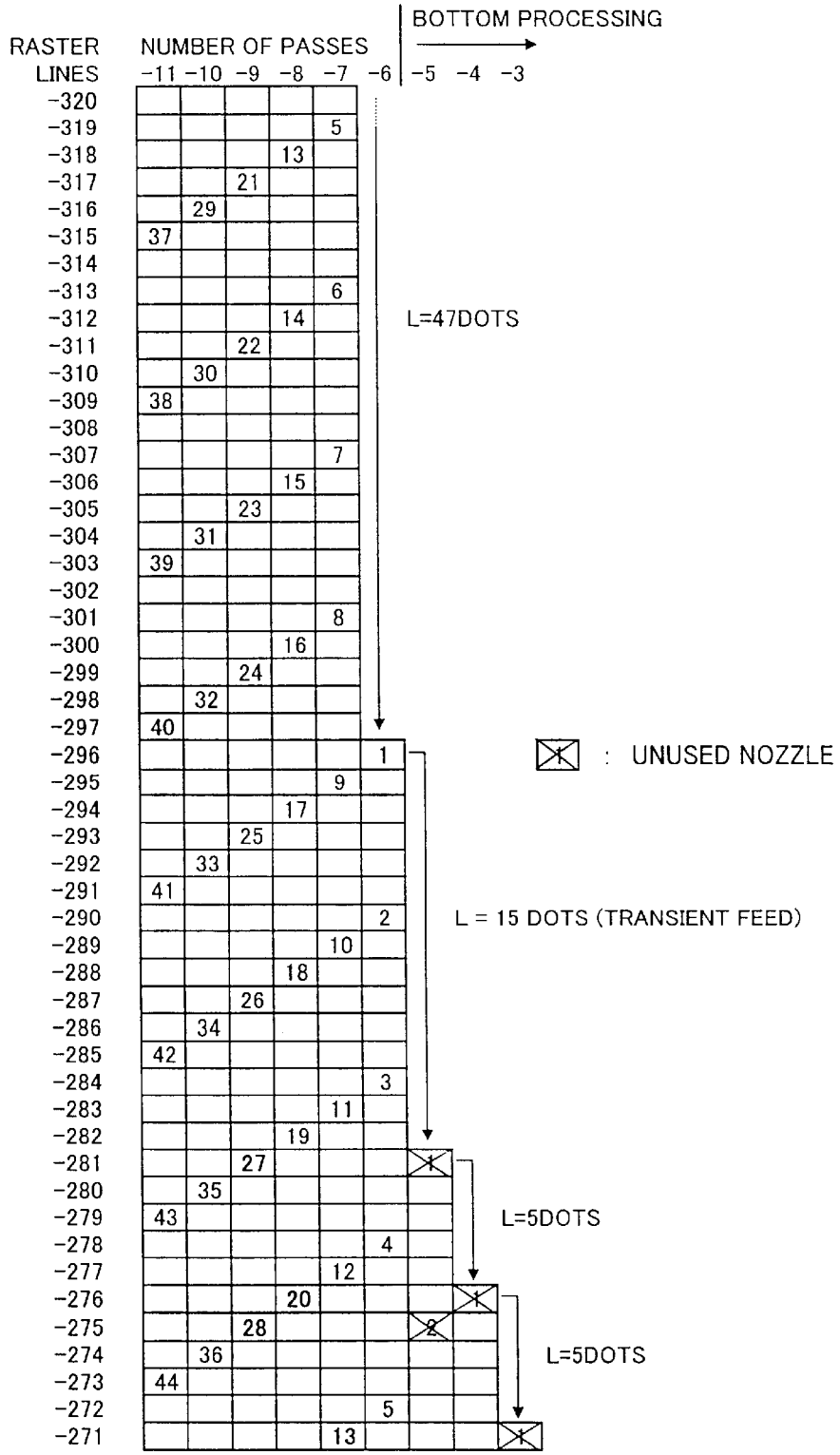
FIG. 20 shows which nozzles record the raster lines within the effective recording range in the various passes in bottom processing during monochromatic printing.

FIGS. 20 and 21 show which nozzles record the raster lines within the effective recording range in the various passes in the bottom processing during monochromatic printing. In FIG. 21, the raster line whose raster line number is 0 is the bottom raster line in the printing execution area. The negative raster line numbers given to the other raster lines indicate the place counting from the bottom raster line.

FIG. 22 is a diagram illustrating the raster line numbers to which the various nozzles are assigned for recording in the various passes in the bottom processing during monochromatic printing. Again in the bottom processing, the number and position of nozzles actually used are adjusted every pass. Performing the bottom processing in this way makes it possible to expand the effective recording range.

As described above, the number of working nozzles N is relatively large during monochromatic printing, so the top processing and the bottom processing are performed. The number of working nozzles N is relatively small during color printing, so the top processing and the bottom processing are omitted. This arrangement simplifies the processing in color printing, while making it possible to ensure a sufficient effective recording range (printing execution area). In particular, with this embodiment, of the several types of colored dots, the yellow dots are formed last, which makes it possible to lessen the deterioration in image quality that is caused by not performing bottom processing in the vicinity of the bottom of the printing paper.

I. Variations of the Actuator

Figure 23:
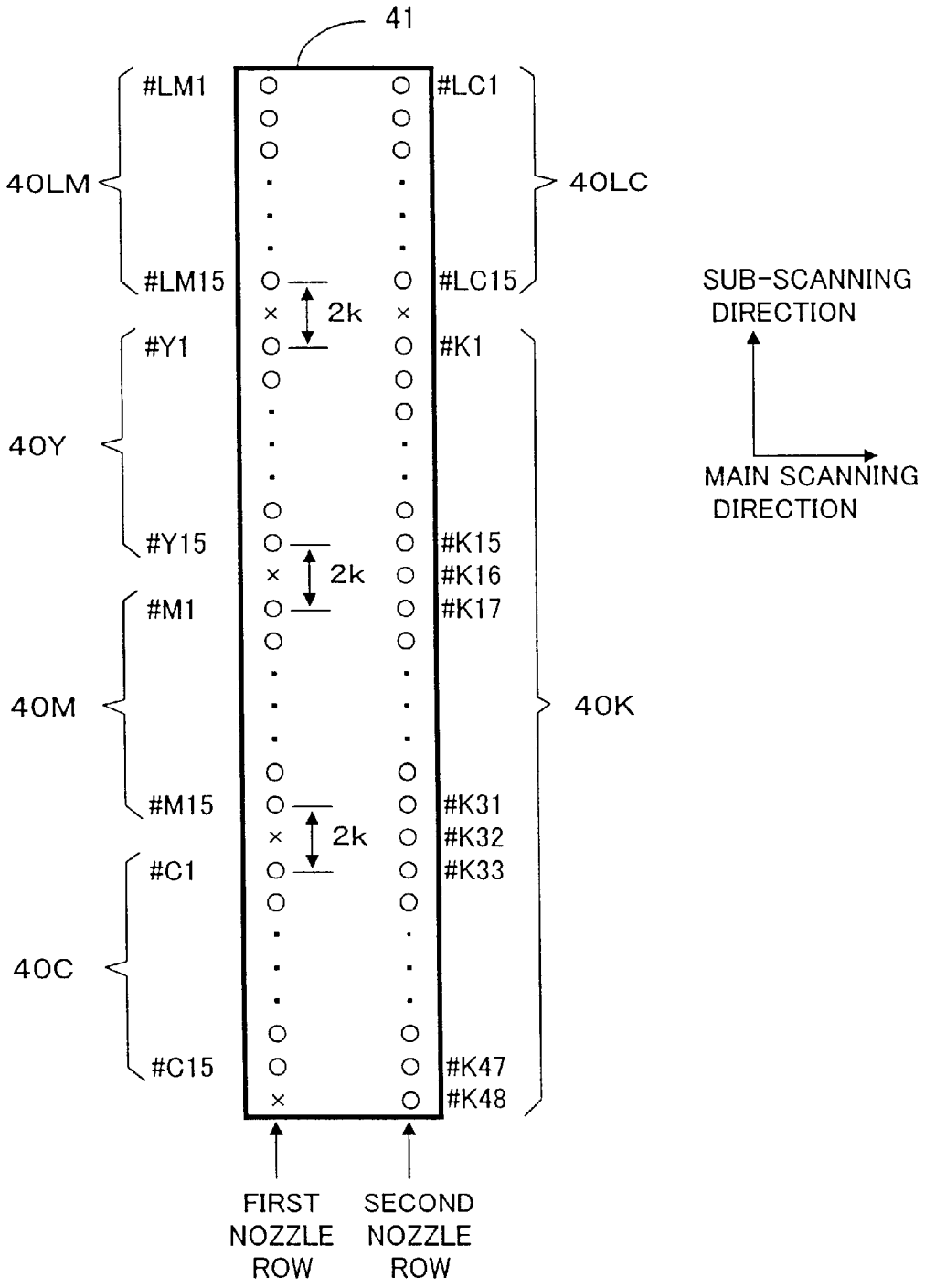
FIG. 23 is a diagram illustrating a first variation of the actuator.

FIG. 23 is a diagram illustrating a first variation of the actuator. This actuator 41 has an additional light magenta nozzle group 40LM above the color nozzle rows of the actuator 40 shown in FIG. 3, and has an additional light cyan nozzle group 40LC above the black nozzle row 40K. Therefore, four color nozzle rows 40C, 40M, 40Y, and 40LM, each consisting of 15 nozzles, are laid out in the first nozzle row on the left side at a spacing 2 k that is twice the nozzle pitch k in the sub-scanning direction. The black nozzle row 40K, which consists of 48 nozzles, and the light cyan nozzle row, which consists of 15 nozzles, are laid out in the second nozzle row on the right side at a spacing 2 k that is twice the nozzle pitch k.

The light magenta ink is nearly the same hue as ordinary magenta ink, but has a lower density than ordinary magenta ink. The same applies to the light cyan ink. Ordinary magenta ink and ordinary cyan ink are also sometimes called "dark magenta ink" and "dark cyan ink."

When the actuator 41 shown in FIG. 23 is used, color printing or monochromatic printing can be executed according to the same recording method as when the actuator 40 shown in FIG. 3 is used. The advantage to using this actuator 41 is that, in addition to the above-mentioned advantages and effects when the actuator 40 in FIG. 3 is used, it is possible to further enhance the image quality of the color printing.

As can be understood from the embodiments in FIGS. 3 and 23, in the present invention it is possible to use a printing head that has a first nozzle row in which a plurality of chromatic color nozzle groups for forming dots of different colors are disposed in the sub-scanning direction, and a second nozzle row that includes the black nozzle group and is disposed parallel to the first nozzle group. The number of nozzles in the black nozzle group should be greater than the number of nozzles in a chromatic color nozzle group of one color. The reason is that this arrangement allows the printing speed to be increased during monochromatic printing. In this respect, it is preferable to set the number of nozzles in the black nozzle group to at least twice the number of nozzles in a chromatic color nozzle group of one color.

Figure 24:
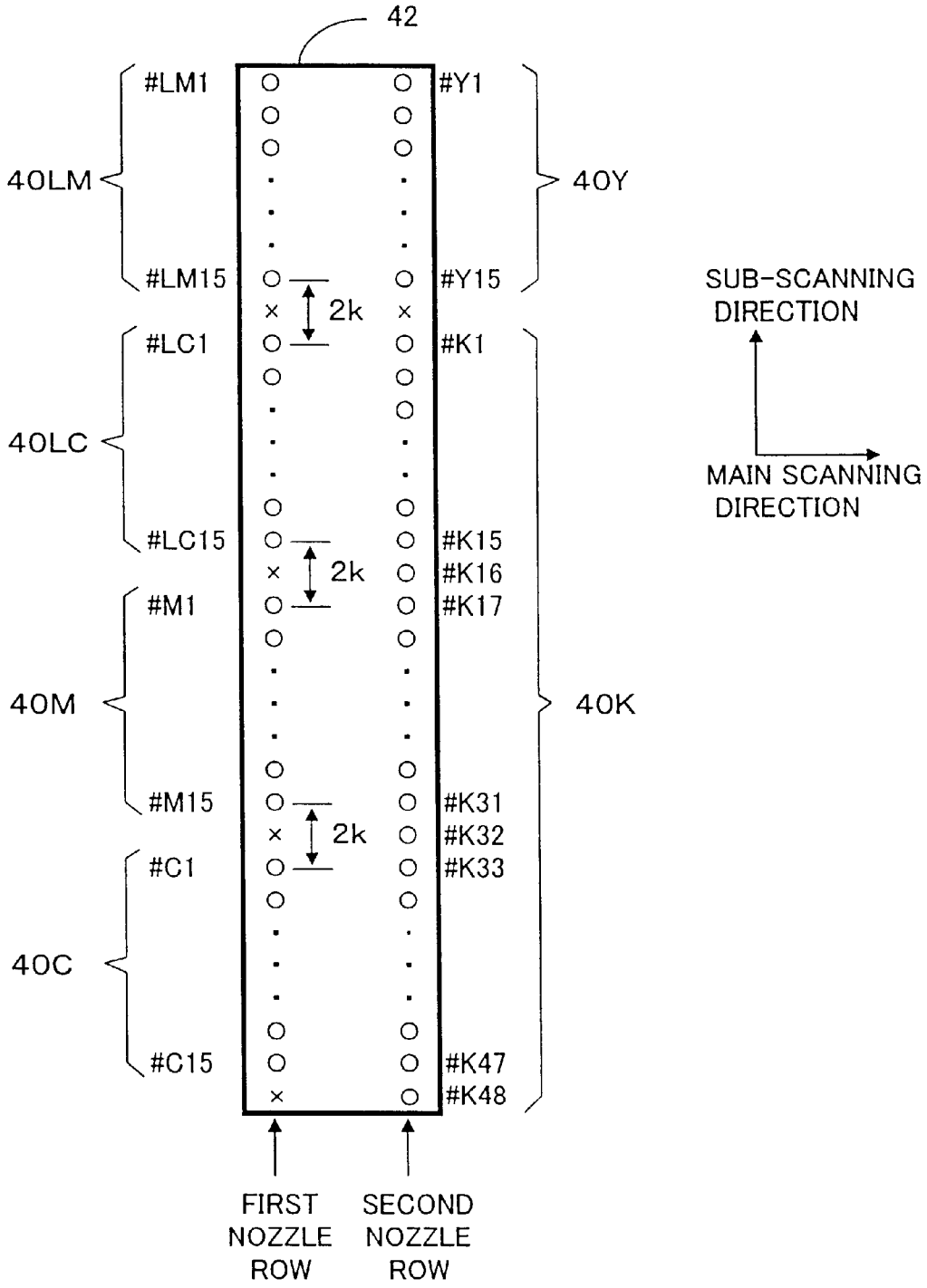
FIG. 24 is a diagram illustrating a second variation of the actuator.

FIG. 24 is a diagram illustrating a second variation of the actuator. This actuator 42 is constructed such that the positions of the light cyan nozzle group 40LC and the yellow nozzle group 40Y in the actuator 41 shown in FIG. 23 are switched. Again when this actuator 42 is used, color printing or monochromatic printing can be executed according to the same recording method as when the actuator 40 or 41 shown in FIG. 3 or 23 is used. As can be seen from this second variation, the yellow nozzle group does not have to be disposed at the rear end of the chromatic color nozzle groups in the sub-scanning direction, and another nozzle group may be disposed there instead. In any case, though, it is preferable for a nozzle group with a relatively low ink density (such as yellow, light cyan, or light magenta) to be disposed at the rear end of the chromatic color nozzle groups in the sub-scanning direction.

Figure 25:
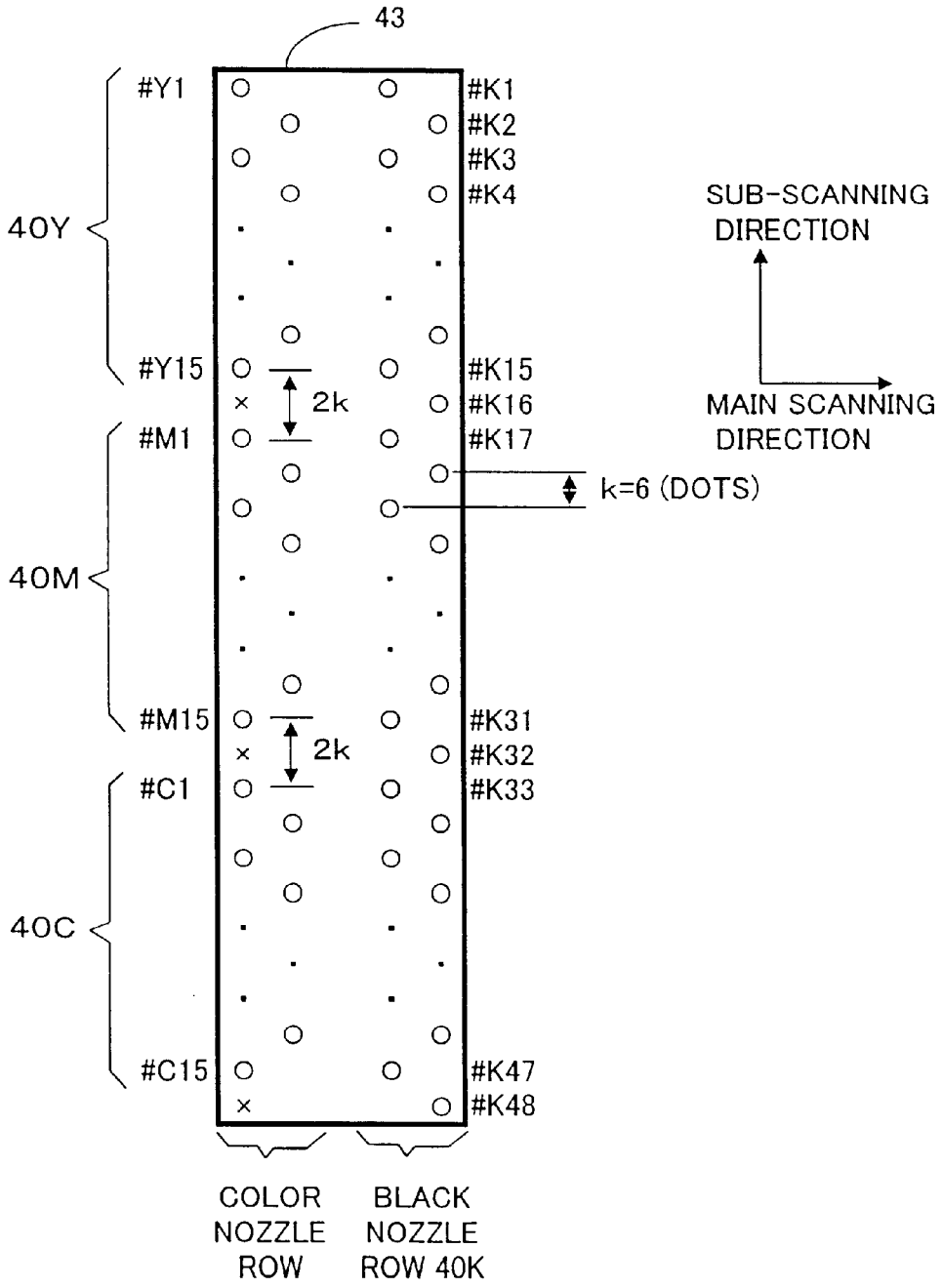
FIG. 25 is a diagram illustrating a third variation of the actuator.

FIG. 25 is a diagram illustrating a third variation of the actuator. This actuator 43 is constructed such that the color nozzle rows and the black nozzle row 40K of the actuator 40 shown in FIG. 3 are laid out in two zigzag rows. For instance, with the black nozzle row 40K, the odd-numbered nozzles #K1, #K3, . . . #K47 are disposed in a row on the left side, while the even-numbered nozzles #K2, #K4 . . . #K48 are disposed in a row on the right. The nozzles in the three chromatic color nozzle groups 40Y, 40M, and 40C are similarly laid out in a zigzag pattern. Even when the nozzles are thus arranged in a zigzag pattern, the three chromatic color nozzle groups 40Y, 40M, and 40C are still lined up along a straight line in the sub-scanning direction. Specifically, in this Specification, the phrase "a plurality of nozzle groups are arranged along a straight line in the sub-scanning direction" just means that the nozzle groups are arranged along a straight line as a whole, and does not necessarily mean that the plurality of nozzles that make up each nozzle group are arranged in a straight line.

J. Other Variations

J1. Variation 1

Depending on the printer, the dot pitch (recording resolution) in the main scanning direction can be set to a different value from the dot pitch in the sub-scanning direction. In this case, the parameters related to the main scanning direction (such as the pixel pitch on the raster lines) are defined by the dot pitch in the main scanning direction, while the parameters related to the sub-scanning direction (such as the nozzle pitch k and the sub-scanning feed amount L) are defined by the dot pitch in the sub-scanning direction.

J2. Variation 2

This invention can also be applied to a drum scanning printer. With a drum scanning printer, the drum rotation direction is the main scanning direction, and the carriage travel direction is the sub-scanning direction. Also, this invention can generally be applied not only to an ink jet printer, but also to any printing device that performs recording on the surface of a printing medium using a printing head having a plurality of dot forming element arrays. The term "dot forming element" as used here refers to the elements for forming dots, such as ink nozzles in an ink jet printer. Such printing devices include fax machines and copiers.

J3. Variation 3

Part of the structure implemented by hardware in the above embodiments may be replaced with software, and conversely, part of the structure implemented by software in the above embodiments may be replaced with hardware. For instance, part of the function of the system controller 54 (FIG. 2) can be executed by the host computer 100.

Computer programs for implementing these functions are available in a format in which they are recorded on a computer-readable recording medium, such as a floppy disk or a CD-ROM. The host computer 100 reads the computer program from this recording medium and transfers it to an internal or external memory device. Alternatively, the computer program may be supplied to the host computer 100 from a program supply device via a communication path. When the function of the computer program is implemented, a computer program stored in an internal memory device is executed by the microprocessor of the host computer 100. A computer program recorded on a recording medium may also be executed directly by the host computer 100.

In this Specification, the host computer 100 is a concept that encompasses hardware devices and operating systems, and refers to a hardware device that operates under the control of an operating system. The computer program causes this host computer 100 to implement the various functions mentioned above. Some of the above functions may be implemented by an operating system rather than an application program.

In the present invention, the term "computer-readable recording medium" is not limited to portable recording media such as flexible disks and CD-ROMs, and also includes internal memory devices inside a computer, such as various types of RAM and ROM, and external memory devices that are fixed to a computer, such as a hard disk.

The present invention was described in detail above and illustrated in the figures, but these are given merely as embodiments, and do not serve to limit the present invention, the idea and scope of which is limited only by the appended claims.

What is claimed is:

1. A printer that performs printing by recording dots on a surface of a printing medium, comprising:

a printing head including a plurality of dot forming elements for forming dots on the printing medium;

a main scanning driver for performing main scanning by moving at least one of the printing head and the printing medium;

a head driver for driving at least some of the plurality of dot forming elements in the printing head during the main scanning, to thereby form dots;

a sub-scanning driver for performing sub-scanning by moving at least one of the printing head and the printing medium; and a controller for controlling printing operation, wherein the printing head includes:

a first dot forming element array in which a plurality of chromaticcolor dot forming element groups are arrayed in a specific order in the sub-scanning direction; and a second dot forming element array in which a black dot forming element group for forming black dots is arranged in parallel to the first dot forming element array, and the controller executes:

during monochromatic printing, the recording of dots in a middle portion of a recording execution area on the printing medium according to a first recording method using only the second dot forming element array, and the recording of dots in the vicinity of a rear end of the recording execution area according to a second recording method in which a sub-scanning feed amount is smaller than in the first recording method, and during color printing, the recording of dots according to a third recording method in both the middle portion and the vicinity of the rear end of the recording execution area using the first and second dot forming element arrays.

2. A printer as defined in claim 1, wherein the first dot forming element array includes a yellow dot forming element group for forming yellow dots, an arrangement order of the plurality of chromatic color dot forming element groups in the first dot forming element array is determined such that yellow dots will be formed after other chromatic color dots at an arbitrary position on the printing medium, and the plurality of chromatic color dot forming element groups include mutually equivalent numbers of dot forming elements, the sub-scanning driver includes:

a first sub-scanning drive mechanism that performs sub-scanning at a relatively high precision; and a second sub-scanning drive mechanism that performs sub-scanning at a relatively low precision, at least after sub-scanning feed by the first sub-scanning drive mechanism is terminated, and the controller controls operation of the dot forming element arrays, during the color printing, so that at least half of the dots formed during main scanning are accounted for by yellow dots when sub-scanning feed is executed by the second sub-scanning drive mechanism without sub-scanning feed being executed by the first sub-scanning drive mechanism in the vicinity of the rear end of the printing medium.

3. A printer as defined in claim 1, wherein, during the color printing, the controller forms black dots using just the dot forming elements present at the same sub-scanning position as the dot forming elements used in a specific chromatic color dot forming element group, the specific chromatic color dot forming element group being a group with which dots can be formed on the printing medium the earliest out of the plurality of chromatic color dot forming element groups in the first dot forming element array.

4. A printer as defined in claim 1, wherein the controller executes:

during the monochromatic printing, the recording of dots in the vicinity of a front end of the recording execution area according to a fourth recording method in which a sub-scanning feed amount is smaller than in the first recording method, and during the color printing, the recording of dots in the vicinity of the front end of the recording execution area according to the third recording method which is also used in both the middle portion and the vicinity of the rear end of the recording execution area.

5. A printing method for executing printing by recording dots on a surface of a printing medium using a printer having a printing head, comprising the steps of:

(a) selecting one of color printing and monochromatic printing; and (b) executing printing in accordance with the selection made in step (a), wherein the printing head comprises:

a first dot forming element array in which a plurality of chromatic color dot forming element groups are arrayed in a specific order in the sub-scanning direction; and a second dot forming element array in which a black dot forming element group for forming black dots is arranged in parallel to the first dot forming element array, the black dot forming element group including a greater number of dot forming elements than each of the chromatic color dot forming element groups does, and the step (b) includes the steps of:

(i) during monochromatic printing, executing the recording of dots in a middle portion of a recording execution area on the printing medium according to a first recording method using only the second dot forming element array, and executing the recording of dots in the vicinity of a rear end of the recording execution area according to a second recording method in which a sub-scanning feed amount is smaller than in the first recording method, and (ii) during color printing, executing the recording of dots according to a third recording method in both the middle portion and the vicinity of the rear end of the recording execution area using the first and second dot forming element arrays.

6. A printing method as defined in claim 5, wherein the first dot forming element array includes a yellow dot forming element group for forming yellow dots, an arrangement order of the plurality of chromatic color dot forming element groups in the first dot forming element array is determined such that yellow dots will be formed after other chromatic color dots at an arbitrary position on the printing medium, and the plurality of chromatic color dot forming element groups include mutually equivalent numbers of dot forming elements, the sub-scanning driver comprises:

a first sub-scanning drive mechanism that performs sub-scanning at a relatively high precision; and a second sub-scanning drive mechanism that performs sub-scanning at a relatively low precision, at least after sub-scanning feed by the first sub-scanning drive mechanism is terminated, and the step (ii) includes a step of controlling operation of the dot forming element arrays, during the color printing, so that at least half of the dots formed during main scanning are accounted for by yellow dots when sub-scanning feed is executed by the second sub-scanning drive mechanism without sub-scanning feed being executed by the first sub-scanning drive mechanism in the vicinity of the rear end of the printing medium.

7. A printing method as defined in claim 5, wherein the step (ii) includes a step of, during the color printing, forming black dots using just the dot forming elements present at the same sub-scanning position as the dot forming elements used in a specific chromatic color dot forming element group, the specific chromatic color dot forming element group being a group with which dots can be formed on the printing medium the earliest out of the plurality of chromatic color dot forming element groups in the first dot forming element array.

8. A printing method as defined in claim 5, wherein the step (ii) includes a step of, during the monochromatic printing, executing the recording of dots in the vicinity of a front end of the recording execution area according to a fourth recording method in which a sub-scanning feed amount is smaller than in the first recording method, and the step (iii) includes a step of, during the color printing, executing the recording of dots in the vicinity of the front end of the recording execution area according to the third recording method which is also used in both the middle portion and the vicinity of the rear end of the recording execution area.

9. A computer program product for causing a computer to execute printing with a computer equipped with a printer having a printing head, comprising:

a computer readable medium; and a computer program stored on the computer readable medium, wherein the printing head comprises:

a first dot forming element array in which a plurality of chromatic color dot forming element groups are arrayed in a specific order in the sub-scanning direction; and a second dot forming element array in which a black dot forming element group for forming black dots is arranged in parallel to the first dot forming element array, the black dot forming element group including a greater number of dot forming elements than each of the chromatic color dot forming element groups does, and the computer program comprises:

a first program that causes the computer to execute the recording of dots according to a first recording method in a middle portion of a recording execution area on the printing medium using only the second dot forming element array, and to execute the recording of dots in the vicinity of a rear end of the recording execution area according to a second recording method in which the sub-scanning feed amount is smaller than in the first recording method, and a second program that causes the computer to execute the recording of dots according to a third recording method in both the middle portion and the vicinity of the rear end of the recording execution area using the first and second dot forming element arrays.

10. A computer program product as defined in claim 9, wherein the first dot forming element array includes a yellow dot forming element group for forming yellow dots, an arrangement order of the plurality of chromatic color dot forming element groups in the first dot forming element array is determined such that yellow dots will be formed after other chromatic color dots at an arbitrary position on the printing medium, and the plurality of chromatic color dot forming element groups include mutually equivalent numbers of dot forming elements, the sub-scanning includes:

a first sub-scanning that is performed at a relatively high precision; and a second sub-scanning that is performed at a relatively low precision, at least after the first sub-scanning is terminated, and the second program includes a computer program that causes the computer to control operation of the dot forming element arrays, during the color printing, so that at least half of the dots formed during main scanning are accounted for by yellow dots when the second sub-scanning is executed without execution of the first sub-scanning in the vicinity of the rear end of the printing medium.

11. A computer program product as defined in claim 9, wherein the second program includes a computer program that causes the computer, during the color printing, to form black dots using just the dot forming elements present at the same sub-scanning position as the dot forming elements used in a specific chromatic color dot forming element group, the specific chromatic color dot forming element group being a group with which dots can be formed on the printing medium the earliest out of the plurality of chromatic color dot forming element groups in the first dot forming element array.

12. A computer program product as defined in claim 9, wherein the first program includes a computer program that causes the computer, during the monochromatic printing, to execute the recording of dots in the vicinity of a front end of the recording execution area according to a fourth recording method in which a sub-scanning feed amount is smaller than in the first recording method, and the second program includes a computer program that causes the computer, during the color printing, to execute the recording of dots in the vicinity of the front end of the recording execution area according to the third recording method which is also used in both the middle portion and the vicinity of the rear end of the recording execution area.

* * * * *